US006314746B2

(12) United States Patent
Ohya et al.

(10) Patent No.: US 6,314,746 B2
(45) **Date of Patent: *Nov. 13, 2001**

(54) REFRIGERATOR WITH A FREEZER COMPARTMENT AND METHOD OF USING IT

(75) Inventors: Keiji Ohya; Toshie Hiraoka; Yuki Nagai, all of Tokyo (JP)

(73) Assignee: Mitsubishi Denki Kabushiki Kaisha (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/350,915

(22) Filed: Jul. 12, 1999

(30) Foreign Application Priority Data

Sep. 25, 1998 (JP) ..... 10-270843
Mar. 25, 1999 (JP) ..... 11-080666

(51) Int. Cl.[7] ..... F25D 17/06
(52) U.S. Cl. ..... 62/187; 62/441
(58) Field of Search ..... 62/441, 186, 187, 62/122

(56) References Cited

U.S. PATENT DOCUMENTS

| | | | | |
|---|---|---|---|---|
| 4,788,832 | * | 12/1988 | Aoki et al. | 62/441 |
| 5,896,748 | * | 4/1999 | Park | 62/441 |
| 5,921,104 | * | 7/1999 | Chang | 62/441 |
| 6,055,826 | * | 5/2000 | Hiraoka et al. | 62/408 |

FOREIGN PATENT DOCUMENTS

| | | |
|---|---|---|
| 58-153063 | 9/1983 | (JP) . |
| 58-210458 | 12/1983 | (JP) . |
| 63-029178 | 2/1988 | (JP) . |
| 64-41878 | 3/1989 | (JP) . |
| 01-106876 | 7/1989 | (JP) . |
| 10-30878 | 2/1998 | (JP) . |
| 10-197130 | 7/1998 | (JP) . |

* cited by examiner

*Primary Examiner*—William E. Tapolcai

(57) ABSTRACT

A refrigerator includes a new temperature zone of freezer compartment as a compartment having a new temperature zone not higher than a lower limit of a maximum ice forming temperature zone and higher than a freezing temperature zone. The new temperature zone may be added as one of selective temperature zones for a switchable compartment which can be switchable so as to have a refrigerating compartment temperature zone, an icing temperature zone, a vegetable compartment temperature zone and a freezer compartment temperature zone.

9 Claims, 17 Drawing Sheets

TEMPERATURE OF TUNA AND CUTTING LOAD

TEMPERATURE OF PORK AND CUTTING LOAD

FREE DRIPPING RATE ON THAWING

HARDNESS AFTER COOKING OR HEATING
(FOR CHEWING BY FRONT TEETH)

HARDNESS AFTER COOKING OR HEATING
(FOR CHEWING BY MOLAR TEETH)

PICTURE OF MUSCULAR TISSUE OF BEEFSTEAK
(AFTER TWO WEEKS OF STORAGE AT −7° C,
TRANSVERSE SECTION, 175 TIMES IN MAGNIFICATION)

PICTURE OF MUSCULAR TISSUE OF BEEFSTEAK
(AFTER TWO WEEKS OF STORAGE AT −18° C,
TRANSVERSE SECTION, 175 TIMES IN MAGNIFICATION)

REFRIGERATOR WITH A FREEZER COMPARTMENT AND METHOD OF USING IT

BACKGROUND OF THE INVENTION

1. Field of the Invention

The present invention relates to a refrigerator with a freezer compartment, which includes a new temperature zone of freezer compartment or a compartment switchable to a new temperature zone of freezer compartment.

2. Discussion of Background

In FIG. 30 is shown a cross-sectional view of a refrigerator as shown in e.g. JP-B-427475. In this figure, reference numeral 200 designates a freezer compartment, reference numeral 100 designates a refrigerating compartment, reference numeral 700 designates an icing temperature compartment, and reference numeral 400 designates a vegetable compartment. The refrigerator is formed by an outer casing and an inner casing with heat insulating material foamed and filled therebetween. In the refrigerator, the compartments are separated and have different temperature zones. Reference numeral 2 designates a fan, and reference numeral 3 designates a cooling device. Part of air which has been cooled by the cooling device 3 is blown out into the freezer compartment 200 by the fan 2, and the remaining air is blown out into the refrigerating compartment 100, the icing temperature compartment 700 and the vegetable compartment 400.

The temperature zones in the respective compartments may be determined so that the freezer compartment 200 is set at from −18° C. to −20° C., the refrigerating compartment 100 is set at from 3° C. to −5° C., the icing temperature compartment (chilled compartment or partially freezing compartment) 700 is set at from 0° C. to −3° C. and the vegetable compartment 400 is set at from 3° C. to 7° C. for instance. The temperature zones are determined, mainly considering the storing terms and the kinds of stored food.

In particular, the icing temperature compartment can provide a longer storing term than the refrigerating compartment or the vegetable compartment to realize about one week of storage.

The freezer compartment can realize about one month of storage by freezing articles of food.

The number of families with not higher than two persons and the number of woman workers caused by a decrease number of children have recently increased, and a further decrease in housework is demanded. From this viewpoint, the icing temperature compartment and the freezer compartment have had an increased frequency of use.

However, the icing temperature compartment 700, for instance, can not always provide a proper temperature for a long term of food storage. This is because the icing temperature compartment has a temperature zone from 0° C. to −3° C., and because there is a good possibility that the temperature in the icing temperature compartment is in a range from −1° C. to −5° C. has a maximum ice forming temperature zone wherein the moisture in articles of food starts freezing and the articles are in such an unstable state to be likely to denature.

The increase number of woman workers increases opportunities to buy required articles of food on weekends. Although it is supposed to usually buy meat, fish and so on required for one week on weekends, it is often impossible to use up the bought meat and fish in one week because of a sudden change in planed meals or a change in the amount of use.

In such cases, it is usual to store articles of food in the freezer compartment in consideration of safety since the one week of storage in the icing temperature compartment is insufficient.

Although the freezer compartment can provide a quite longer term of storage than the icing temperature compartment by freezing articles of food, there is a case that a drop in the temperature of the articles of food to −18° C. completely freezes the moisture in the articles of food to damage surfaces of the articles of food or make the articles of food tasteless.

In addition, it is necessary to thaw an article of food for cooking since the article is completely frozen. It is usual to spontaneously thaw an article of food or thaw an article of food by a microwave oven and so on. It usually takes more than one hour to spontaneously thaw an article of food, making the thawing extremely troublesome. Although it takes a shorter time to thaw an article of food by a microwave oven, it is often to heat the surface of the article too much when a central portion in the article starts being thawed. This is because an article of food is gradually thawed from the surface thereof toward the central portion thereof.

Unless next required part of an article of food is separated from the entire article before freezing the entire article, it is necessary to thaw the entire article at one time since the frozen article is too hard to separate the next required part from the entire article.

If a procedure wherein even unused part of an article of food is also thawed and frozen again is repeated, the article of food has freshness degraded, and it takes some time for thawing and cooking, which is contradictory to a decrease in housework.

Since the conventional refrigerator is constructed as stated above, there is a possibility that the icing temperature compartment stores articles of food in the maximum ice forming zone (from −1° C. to −5° C.), creating a problem in that the freshness in the articles is likely to degrade.

There is also created a problem in that the one week of storage in the icing temperature compartment has become insufficient due to a change in family make-up and an increase number of woman workers.

There is also created a problem in that the food storage in the freezer compartment damages the surfaces of articles of food since the articles are completely frozen.

There is also created a problem in that the completely frozen articles of food require to be thawed for cooking, which introduces failure in thawing and needs troublesome work.

It is also created a problem in that when an article of food is frozen, it is necessary to thaw the entire frozen article to use even a small part of the frozen article, and that the remaining unused part of the article is required to be frozen again, making the freshness in the article degraded.

SUMMARY OF THE INVENTION

It is an object of the present invention to solve these problems, and to provide a refrigerator which includes a new temperature zone of freezer compartment having a longer term of food storage than an icing temperature compartment and capable of minimizing the degradation of stored articles of food.

It is another object of the present invention to provide a refrigerator with a freezer compartment capable of being conveniently used and offering a food storing state which requires no wasteful time for cooking.

The present invention provides a refrigerator with a freezer compartment, which comprises a compartment for storing articles of food, which has one or more temperature zones; and a new temperature zone of freezer compartment as a compartment having a new temperature zone not higher than a lower limit of a maximum ice forming temperature zone and higher than (that is to say, beyond) a freezing temperature zone.

The new temperature zone may include a temperature that allows articles of food stored in the new temperature zone of freezer compartment to be divided without be thawed.

The new temperature zone of freezer compartment may be a compartment which can have a temperature therein changed to at least one of a freezer compartment temperature, a temperature in the new temperature zone, a refrigerating compartment temperature, a vegetable compartment temperature and an icing temperature.

A set temperature or an actual temperature in the compartment may be variably displayed on an outer or inner surface of the refrigerator. The set temperature or the actual temperature includes a temperature in the new temperature zone, and at least one of the freezer compartment temperature, the refrigerating compartment temperature, the vegetable compartment temperature and the icing temperature.

The refrigerator may further comprise one or more freezer compartments having the freezing temperature zone set therein.

The refrigerator may further comprise at least two freezer compartments, wherein one of the freezer compartments can be changed to the new temperature zone of freezer compartment.

At least one of the freezer compartments may be automatically and variably set at a temperature in the new temperature zone.

The new temperature zone of freezer compartment may be provided above the freezer compartments.

The refrigerator may further comprise a duct for blowing out cooled air into the new temperature zone of freezer compartment; an outlet provided to the duct; a temperature detector for detecting a temperature in the new temperature zone of freezer compartment, and a damper for controlling an amount of the blown cooled air into the new temperature zone of freezer compartment in response to the detected temperature.

The duct may be provided in at least one of a top wall and a side wall of the new temperature zone freezer compartment.

The new temperature zone of freezer compartment may sequentially change a temperature therein in the new temperature zone.

The new temperature zone of freezer compartment may be configured to cool the article of food at a cooling speed faster than that in an icing temperature compartment and slower than that in a freezer compartment.

The new temperature zone of freezer compartment may prevent an article of food with a rich content of salt or sugar from being frozen.

The new temperature zone of freezer compartment may be provided as one of sections divided in a single compartment.

The new temperature zone of freezer compartment may be provided with a return path for cooled air so that the return path is independent of other return paths for cooled air.

The present invention also provides a method for using a refrigerator wherein a compartment for storing articles of food is provided so as to have one or more temperature zones and wherein the compartment can be changed to a new temperature zone of freezer compartment having a new temperature zone not higher than a maximum ice forming temperature zone and higher than a freezing temperature zone; comprising storing an article of food in the compartment, changing, based on a required storing term, a temperature in the compartment to a temperature in the new temperature zone; and taking the article out of the compartment changed to the new temperature zone to cook the article.

In accordance with the refrigerator with a freezer compartment according to the present invention, it is possible to store articles of food in the new temperature zone of freezer compartment for a longer term than in an icing temperature compartment, and to save the time and labor for cooking.

When the new temperature zone includes a temperature that allows an article of food stored in the new temperature zone of freezer compartment to be divided without being thawed, it is easy to divide a stored article of food immediately after taking the article out of the refrigerator. This arrangement can provide a user-friendly refrigerator.

When the new temperature zone of freezer compartment is a compartment which can have the temperature therein changed to at least one of the freezer compartment temperature, a temperature in the new temperature zone, the refrigerating compartment temperature, the vegetable compartment temperature and the icing temperature, it become convenient to use the refrigerator, and it is possible to make good use of the refrigerator in a reasonable way.

When a set temperature or an actual temperature in the compartment, which includes a temperature in the new temperature zone, and at least one of the freezer compartment temperature, the refrigerating compartment temperature, the vegetable compartment temperature and the icing temperature is variably displayed on the outer or inner surface of the refrigerator, the temperature zone in the compartment can be seen at a glance, and the refrigerator becomes convenient to a user.

When the refrigerator further comprises one or more freezer compartments having the freezing temperature zone, it is possible to separately store articles of food depending on usage thereof.

When the refrigerator further comprises at least two freezer compartments, wherein one of the freezer compartments can be changed to the new temperature zone of freezer compartment, it becomes convenient to use the refrigerator.

When at least one of the freezer compartments can be automatically and variably set at a temperature in the new temperature zone, proper temperature setting can be made with simple operation, providing the refrigerator with an energy-saving property.

When the new temperature zone of freezer compartment is provided above the ordinary freezer compartments, it is easy to take out articles of food in the new temperature zone of freezer compartment having a greater frequency of use than the ordinary freezer compartments.

When the refrigerator further comprises the duct for blowing out cooled air into the new temperature zone of freezer compartment, the outlet provided to the duct, the temperature detector for detecting the temperature in the new temperature zone of freezer compartment, and the damper for controlling the amount of the blown cooled air into the new temperature zone of freezer compartment in response to the detected temperature, it is possible to control the temperature in the new temperature zone of freezer compartment so as to match the freezer compartment to multiple purposes and to provide the refrigerator with an energy-saving property.

When the duct is provided on at lest one of the top wall and the side wall of the new temperature zone of freezer compartment, it is possible to improve a temperature distribution in the new temperature zone of freezer compartment.

When the new temperature zone of freezer compartment is configured to be capable of sequentially changing the temperature therein in the new temperature zone, it is possible to store articles of food in a better frozen state.

When the new temperature zone of freezer compartment is configured to cool an article of food at a cooling speed faster than that in an icing temperature compartment and slower than that in a freezer compartment, the article can be stored without loosing taste.

When the new temperature zone of freezer compartment is configured to be capable of preventing an article of food with a rich content of salt or sugar from being frozen, such an article can be provided with a novel and good taste.

When the new temperature zone of freezer compartment is provided as one of sections divided in a single compartment, the refrigerator can be provided so as to have a temperature zone matched with dietary habits of a user.

When the new temperature zone of freezer compartment is provided with a return path for cooled air so that the return path is independent of other return paths for cooled air, the formation of ice by the cooled air can be avoided.

In accordance with the method for using a refrigerator according to the present invention, wherein a compartment for storing articles of food is provided so as to have one or more temperature zones, and wherein the compartment can be changed to a new temperature zone of freezer compartment having a new temperature zone not higher than a maximum ice forming temperature zone and higher than a freezing temperature zone; comprising storing an article of food in the compartment, changing, based on a required storing term, a temperature in the compartment to a temperature in the new temperature zone; and taking the article out of the compartment changed to the new temperature zone to cook the article, the article can be used in an easy-to-cook way with good timing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Embodiment 1

Now, a first embodiment according to the present invention will be described, referring to the accompanying drawings.

Figure 1:
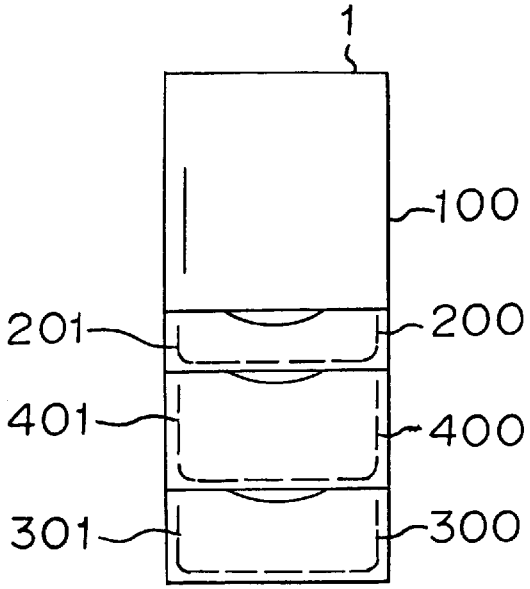
FIG. 1 is a front view of the refrigerator according to a first embodiment of the present invention.

In FIG. 1 is shown a front view of the refrigerator according to the first embodiment. In this Figure, reference numeral 1 designates a main body of the refrigerator. The main body 1 comprises a refrigerating compartment 100 with a door provided at an upper most portion in the main body, a freezer compartment 200 with a drawer provided under the refrigerating compartment 100, a new temperature zone of freezer compartment 300 with a drawer provided at a lowest portion in the main body and working as a freezer compartment at a higher temperature than an ordinary freezing temperature (−18° C.) to carry out soft-freezing, and a vegetable compartment 400 with a drawer provided between the new temperature zone of freezer compartment 300 and the freezer compartment 200.

The freezer compartment 200 includes a storage casing 201 to store articles of food. The new temperature zone of freezer compartment 300 also includes a storage casing 301 to store articles of food. The vegetable compartment 400 also includes a storage casing 401 to store articles of food.

Figure 2:
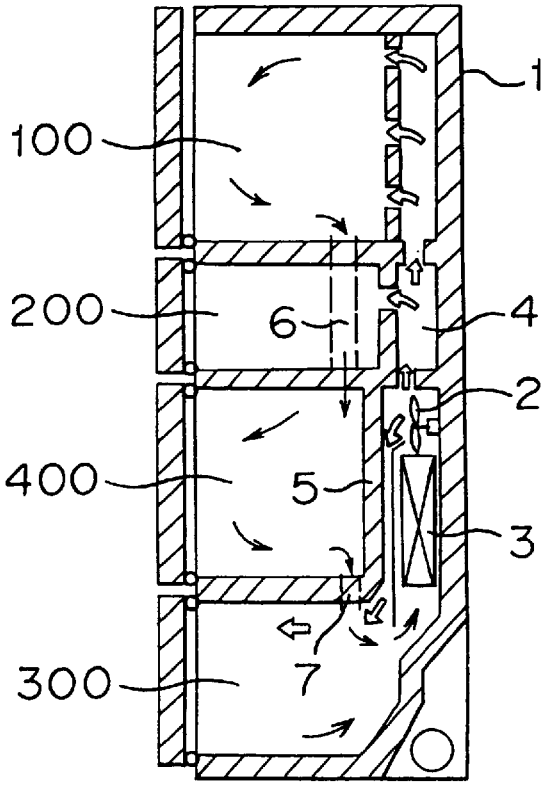
FIG. 2 is a schematic view showing the air path structure according to the first embodiment of the present invention.

FIG. 2 is shown a cross-sectional side view of the refrigerator to show the air path structure according to the first embodiment. Air is cooled by a cooling device 3 and is circulated in the main body 1 by a fan 2. Part of the cooled air is supplied into the new temperature zone freezer compartment 300 through an air path 5 for the new temperature zone of freezer compartment. The remaining part of cooled air is supplied into the freezer compartment 200 through an air path 4 for the freezer compartment. Part of the cooled air which has entered the air path 4 is supplied into the refrigerating compartment 100 above the freezer compartment to cool the inside of the refrigerating compartment. The cooled air which has cooled the inside of the refrigerating compartment 100 is supplied into the vegetable compartment 400 through a return path 6 for the refrigerating compartment to cool the inside of the vegetable compartment. The cooled air which has cooled the inside of the vegetable compartment is returned to the cooling device 3 through a return path 7 for the vegetable compartment.

Now, the new temperature zone of freezer compartment 300 will be explained.

Figure 3:
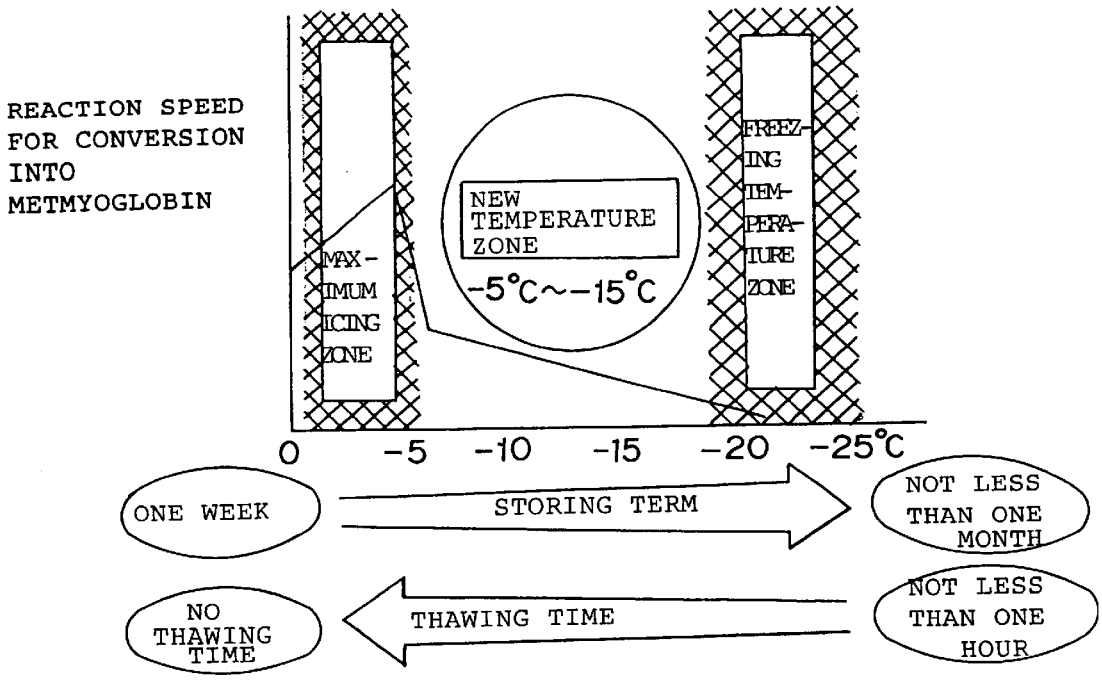
FIG. 3 is a graph showing the new temperature zone according to the first embodiment of the present invention.

In FIG. 3 is shown reaction speeds for degree of change in the surface color of an article of food (conversion into metmyoglobin) with respect to storing temperatures. The ordinate represents reaction speeds for conversion to metmyoglobin, and the abscissa represents food storing temperatures. Under the abscissa are indicated a food storing term and a thawing time for the food. The reaction speeds for conversion into metmyoglobin take the maximum value in a maximum ice forming temperature zone of from −1° C. (upper limit) to −5° C. (lower limit) wherein moisture in articles of food start freezing. In the maximum ice forming temperature zone, articles of food are liable to be subjected to denaturation, takes an unstable state and degrades the surface color thereof. This means that the cells in the articles are damaged to make the articles tasteless.

In accordance with the present invention, the temperature in the new temperature zone of freezer compartment is set at not higher than −5° C. in order to store articles of food in such a way to avoid the maximum ice forming temperature zone. The temperature in the new temperature zone of freezer compartment may be set at a temperature value higher than e.g. −15° C. in order to store articles of food in such a way to avoid the freezing temperature zone (not higher than −18° C.) since it takes some time to thaw articles of food frozen in the freezing temperature zone though the storing term can be long in the freezing temperature zone.

As explained, the articles of food in the new temperature zone of freezer compartment 300 can not be frozen hard unlike articles of food stored in the ordinary freezer compartment since the articles of food in the new temperature zone of freezer compartment are stored in a range from −5° C. to −15° C. for instance. The articles of food in the new temperature zone of freezer compartment are softly frozen (subjected to soft-freezing, lightly frozen or cuttably frozen) so that the articles of food can be divided by a kitchen knife or hands. In addition, the storing term for the articles of food can be lengthened to not less than one week, and the articles of food can be kept in a better state than the articles of food in the icing temperature compartment for a long time.

Figure 4:
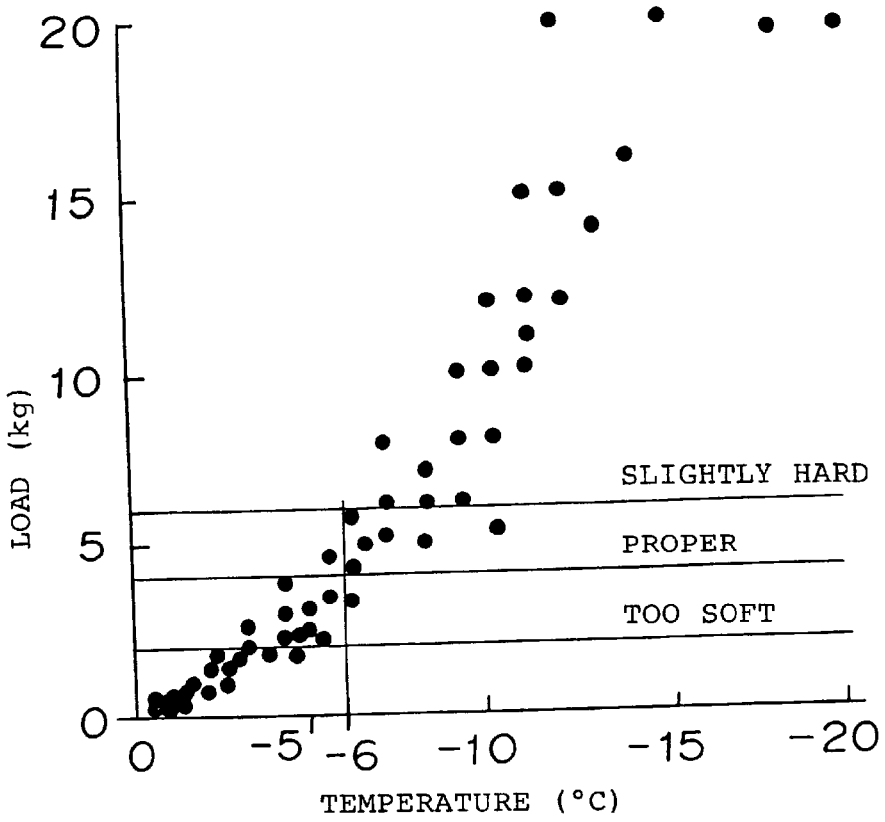
FIG. 4 is a graph showing the relationship between temperatures of an article of food and cutting loads in the first embodiment.
Figure 5:
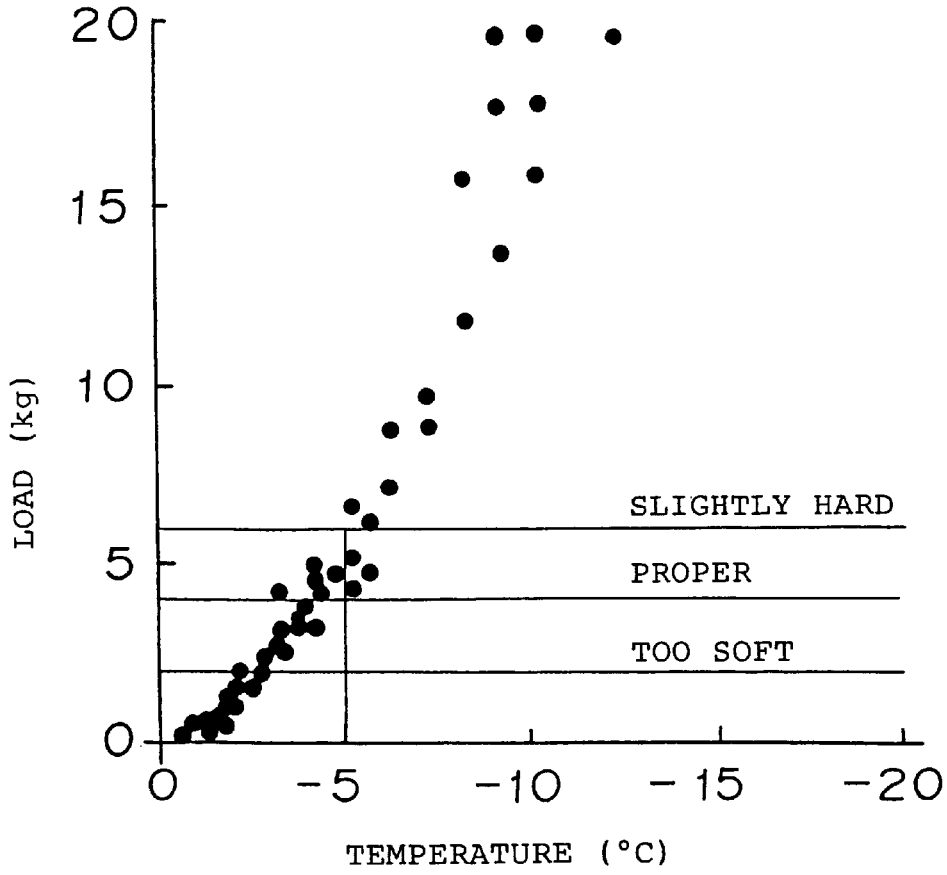
FIG. 5 is a graph showing the relationship between temperatures of another article of food and cutting loads in the first embodiment.

In FIGS. 4 and 5 are shown data of the relationships between temperatures of articles of food and cutting loads, which indicate how a person feels about the articles of food (slightly hard, proper or too soft) when he or she actually cuts the articles with a knife and so on. In FIG. 4 is shown the results of tuna as the articles, and in FIG. 5 is shown the results of pork as the articles. It has been found that most articles of food are frozen properly hard or slightly hard so as to be cuttable when they are stored at a temperature from −5° C. to −7° C., and that the cutting loads are about from 5–6 kg at that time.

In Table 1 are shown acceptable storing terms for articles of food in storing compartments having different storing temperatures. The storing compartments are a chilled compartment (about 0° C.), a partially freezing compartment (about −3° C.) and a new temperature zone of compartment (about −7° C.).

TABLE 1

Acceptable storing terms (days) at different storing temperatures
(The underlined values indicate the minimum acceptable storing terms.)

| | | Storing temperature (° C.) | | |
|---|---|---|---|---|
| Article of food | Criteria | Chilled compartment (0) | Partially freezing compartment (−3) | New temperature zone of compartment |
| For tuna sashimi (fresh slices of raw tuna) | Sensory evaluation ④ | _4 | _6 | 14 |
| | K value 20% | _4 | 10 | 30 |
| For tuna to be cooked | Sensory evaluation ③ | _6 | 10 | 24 |
| | K value 60% | 24 | Not less than 40 | Not less than 40 |
| | Bacteria on surface $10^4$ | 18 | Not less than 40 | Not less than 40 |
| For ground meet to be cooked | Sensory evaluation ③ | 6 | 14 | 35 |
| | Numbers of living bacteria $10^6$ | _5 | 10 | Not less than 40 |
| Broccoli (branched) | Sensory evaluation ③ | 12 | Not less than 35 | Not less than 35 |
| | Numbers of living bacteria $10^6$ | 25 | Not less than 35 | Not less than 35 |
| Meat source (reheated one stored in a can | Sensory evaluation ③ | Not less than 35 | Not less than 35 | Not less than 35 |
| | Numbers of living | Not less than 35 | Not less than 35 | Not less than 35 |

TABLE 1-continued

| Acceptable storing terms (days) at different storing temperatures (The underlined values indicate the minimum acceptable storing terms.) | | | | |
|---|---|---|---|---|
| | | Storing temperature (° C.) | | |
| Article of food | Criteria | Chilled compartment (0) | Partially freezing compartment (−3) | New temperature zone of compartment |
| commercially available) | bacteria $10^6$ | | | |

Sensory evaluation criteria: ⑤ absence of stench or discoloration, ④ presence of slight stench and slight discoloration, ③ eatable limit, ② presence of stench and discoloration, ① rotten In Table 1 are shown acceptable storing terms (days) under criteria for sashimi or fresh slices of raw fish (fresh slices of raw tuna), fish to be cooked (for tuna to be cooked), meat to be cooked (for ground meat to be cooked), branched (boiled) vegetables (broccoli) and processed food such as caned food (meat source). As the criteria are selected required ones among sensory evaluation criteria (① rotten, ② presence of stench and discoloration, ③ eatable limit, ④ presence of slight stench and discoloration, and ⑤ absence of stench or discoloration), a K value criterion, criterion of the numbers of bacteria on surface, and a criterion of the number of living bacteria. With regard to the K value, it is normally determined that when the value is not greater than 20%, articles of food are eatable without being heated, and that when the value is not greater than 60%, articles of food are at the eatable limit though being required to be heated. With respect to the number of bacteria on surface, it is normally determined that when the number is $10^4$, articles of food are at the eatable limit. With respect to the number of living bacteria, it is normally determined that when the number is $10^6$, articles of food are at the eatable limit. From this viewpoint, days that passed until articles of food reach at the eatable limit were found. The K value is a ratio of substance associated with ATP (adenosine triphosphate), which indicates the freshness index of articles of food.

With regard to the acceptable storing term for tuna sashimi or fresh slices of raw tuna, the days at respective storing temperatures are shown when the sensory evaluation was ④ and the K value was 20% as the criteria. With regard to the acceptable storing term in the case of tuna to be cooked, the days at respective storing temperatures are shown when the sensory evaluation was ③, the K value was 60% and the number of bacteria on surface was $10^4$ as the criteria. With respect to the acceptable storing term for ground meat to be cooked, for branched broccoli and for reheated meat source stored in a can commercially available, days at the respective storing temperatures are shown when the sensory evaluation was ③ and the number of living bacteria was $10^6$ as the criteria. The underlined values in Table 1 are the shortest ones among the acceptable storing terms (days) under respective pairs of criteria. For example, the acceptable storing term for tuna sashimi in the new temperature zone of freezer compartment was 14 days in terms of the sensory evaluation criteria and 30 days in terms of the K value criteria, and consequently the shortest acceptable storing term (the underlines portion) was 14 days.

According to these data, it has been determined that the new temperature zone (about −7° C.) can store articles of food not required to be cooked or heated for not less than 2 weeks and articles of food to be cooked for not less than 3 weeks, and that the new temperature zone can store articles of food for 2 or 3 weeks without causing trouble.

The data also show that the acceptable storing terms in the new temperature zone were days of not less than 3 times the temperature zone in the chilled compartment and days of not less than 2 times the temperature zone in the partially freezing compartment, and that the new temperature zone of compartment is superior to the chilled compartment or the partially freezing compartment in terms of the acceptable storing term. With respect to vegetable and processed products, the data show that the shortest acceptable storing terms were not less than 35 days. Since such articles of food vary in initial quality, storing of such articles of food at a lower temperature in the new temperature zone is superior in terms of convenience in separation of the articles or thawing of the articles and storage of the articles.

Now, thawing times for frozen articles of food are shown.

Table 2 shows how long articles of food stored at −18° C. take to become cuttable in different thawing methods (thawing in a refrigerating compartment, a room temperature and a microwave oven). Table 3 shows what surface temperature articles of food stored at −7° C. and articles of food stored at −18° C. have when being thawed in a microwave oven.

TABLE 2

| Time that articles of food stored at −18° C. take to become cuttable (time required for the temperatures of the articles to reach −6° C.: minute) | | | |
|---|---|---|---|
| Thawing method Articles of food | Refrigerating compartment | Room temperature | Microwave oven |
| Beefsteak (8 × 11 × 2 cm) | 50 | 18 | 1 |
| Mixture of ground beef and ground pork (8 × 11 × 2 cm) | 66 | 23 | 1 |
| Tuna (6 × 11 × 2 cm) | 52 | 21 | 1 |

TABLE 3

| Surface temperature of articles of food when having been thawed in a microwave oven | | |
|---|---|---|
| Surface temperature of article (° C.) | minimum | maximum |
| −7° C.* All the articles | −3 | 0 |
| −18° C. Beefsteak | −3 | 3 |
| −18° C. A mixture of ground beef and ground pork | −3 | 9 |
| −18° C. Tuna | −3 | 6 |

*No thawing was required in the case of −7° C. (When the articles was put at a room temperature.)

Table 2 shows that thawing of articles of food in a refrigerating compartment or at a room temperature involves a troublesome work, such as taking out of the articles in advance, and a time-consuming work since it takes some time to thaw the articles. Thawing of articles of food in a microwave oven is not time-consuming though such a troublesome work is needed. When articles of food are stored at −7° C. in accordance with the present invention, the waiting time is 0 since articles of food are cuttable immediately after they are taken out.

Table 3 shows that the articles of food stored at −7° C. had a surface temperature of 0° C. as the maximum value when having been thawed in a microwave oven. This value is much lower than surface temperatures of 3° C., 6° C. and 9° C. of the articles of food stored at −18° C. when having been thawed in the microwave oven. This means that the articles stored at −7° C. can minimize degration due to thawing.

Figure 6:
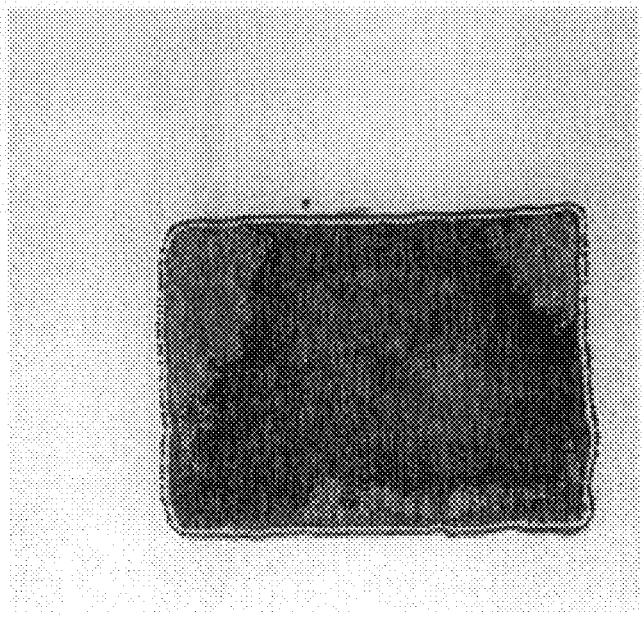
FIG. 6 is a view showing the distribution of surface temperatures of an article of food in the first embodiment.
Figure 7:
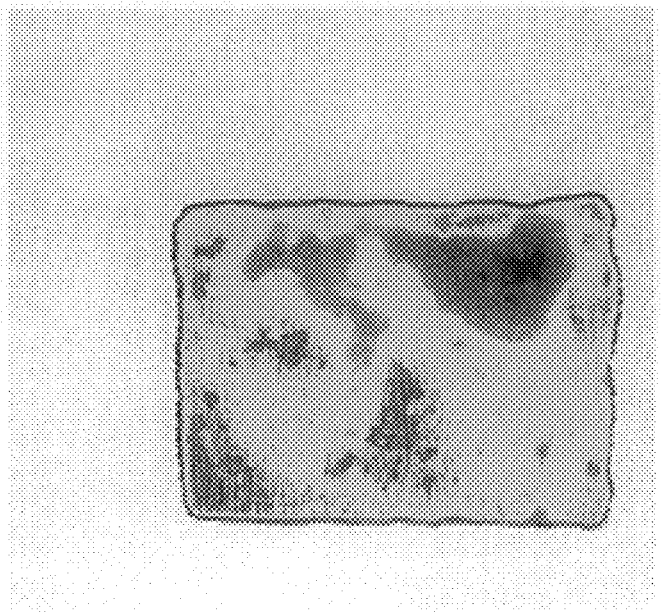
FIG. 7 is a view showing the distribution of surface temperatures of another article of food in the first embodiment.

In FIG. 6 is shown a surface temperature distribution of an article of food that had been stored at −7° C. and was taken out in a place at a room temperature. In FIG. 7 is shown a surface temperature distribution an article of food that had been stored at −18° C. and was thawed in a microwave oven. In FIG. 6, the entire surface of the meat was in the same color, and the surface temperature of the article was equal in the entirety. In FIG. 7, the surface of the meat varied in color and the surface temperature of the article had a wide distribution. The article shown in FIG. 7 had higher temperatures in the entirety than the articles shown in FIG. 6. When ground meat was thawed in the microwave oven, fatty portions of the ground meat had higher temperatures since the portions were apt to be selectively heated. The surface temperature distribution after thawing varies on the storing temperature for an article of food.

This shows that since articles of food stored at −7° C. can be thawed without using a microwave oven and so on (can be used without being thawed), it is possible to avoid an uneven temperature distribution or degration due to overthawing, which is caused when articles of food stored at −18° C. are thawed in a microwave oven.

As explained, the new temperature zone is superior to other temperature zones in terms of the time that articles of food take to be thawed to a cuttable temperature. The fact that articles of food can be cut immediately after being taken out results in a reduction in the time required for housework since finely cutting of, e.g., ground meat taken out enlarges an area of the article to be exposed to air, thereby accelerating thawing, and since cutting articles of food immediately after taking out is very convenient even when the articles are thawed in a raw state.

Now, how to set the temperature in the new temperature zone of freezer compartment 300 will be explained.

Figure 8:
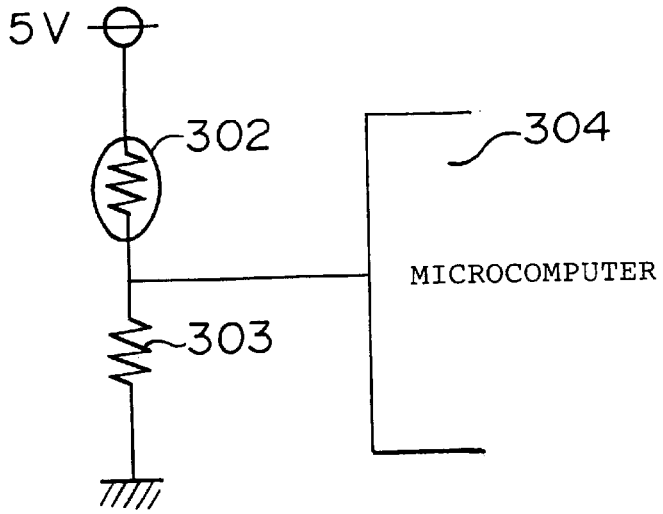
FIG. 8 is a circuit diagram of the new temperature zone setting device according to the first embodiment of the present invention.

In FIG. 8 is shown a temperature setting device for the new temperature zone of freezer compartment 300. In this figure, reference numeral 302 designates a thermistor for temperature detection (temperature detector) provided in the new temperature zone of freezer compartment 300, reference numeral 303 designates a preset resistor and reference numeral 304 designates a microcomputer which outputs commands for opening and closing a damper (indicated by 5*a* in FIG. 23), and to which a dc voltage of 5V is applied. The damper 52 controls the amount of blown cooled air into the new temperature zone of freezer compartment 300. The damper 5*a* is provided in the air path 5 for the new temperature zone of freezer compartment. When the thermistor for temperature detection 302 detects that the temperature in the new temperature zone of freezer compartment is not less than a certain set temperature, the damper is opened to open an cooled air outlet, supplying the cooled air into the new temperature zone of freezer compartment 300 for temperature control.

In this embodiment, the present resistor 303 is coupled in series with the thermistor for temperature detection 302 provided in the new temperature zone of freezer compartment 300 as shown in FIG. 8, and an A/D value corresponding to a voltage across the preset resistor is inputted into the microcomputer 304 to determine a set temperature. This arrangement can provide measures to determine the set temperature in an inexpensive cost.

When the preset resistor is of a variable type, the temperature in the new temperature zone of freezer compartment can be sequentially changed so as to set at an arbitrary temperature. The temperature in the other compartments can be set by similar measures.

The temperature selection in the new temperature zone according to the present invention will be described. Although articles of food are frozen and stored at a temperature to be capable of being cut in the new temperature zone, the freezing temperature and the frozen state inevitably vary with articles of food. The freezing temperature and the frozen state vary with not only the articles of food per se but also the processed state thereof (such as a seasoning way and a cooking way). In particular, how to store articles of food vary with families. From this viewpoint, it is required to be taken into account that temperature setting can be changed in order to control the frozen state so as to match with the kind or the processed state of articles of food to be stored.

For example, when meat or fish is stored without being cooked (or heated) or processed, it is preferable to set the temperature at −7° C. When articles of food seasoned with miso (fermented soybean paste), soy source or salt, or fatty articles of food are stored, it is preferable to set the temperature at a lower level, such as −10° C., than that for uncooked or unprocessed articles of food since the seasoned or fatty articles have a lower freezing temperature.

The new temperature zone according to the first embodiment can extend the storing term for articles of food to a term of about two weeks. Even if articles of food bought on, e.g., weekends are not completely spent due to a change in planed meals, the remaining portions of the article or the remaining articles can be stored in safety until the next week.

Since the moisture in food is not completely frozen, the surface of the stored food can be prevented from being damaged and the taste is prevented from degraded. Articles of food with much moisture (such as curried food, stew, grated radish and baked eggplants) can not be frozen hard, avoiding a case wherein such food is desiccated to destroy taste or crispness.

The articles of food which are stored in the new temperature zone of freezer compartment can be softly frozen without being frozen hard, and the articles of food do not need thawing by a microwave oven or not less than one hour of spontaneous thawing. The articles of food stored in the new temperature of compartment can be cut by a kitchen knife without need for thawing, eliminating failure in thawing and avoiding thawing work.

Since the articles of food in the new temperature zone freezer compartment (soft-freezing room) can be divided even just after having been taken out of the soft-freezing room, the articles of food are not required to be divided before storage, eliminating preparation before storage.

Since articles of food are not frozen hard in the new temperature zone which provides the largest storing term in terms of storage of the articles in a cuttable state, articles of food containing a lot of sugar content, such as fruit like a banana, dessert like pudding and jelly, and fruit juice take a sherbet form in the new temperature zone. The new temperature zone can provide good taste possible only in soft-freezing and unavailable in freezing or refrigerating. This also applies to articles of food containing salt, such as salted cod roe, salted salmon and beverage for sports occasions in addition to the articles of food containing a lot of sugar content.

The new temperature zone can prevent ordinarily beer (alcohol content of about 5%) from being frozen. The new temperature zone can avoid a case that a beer bottle is exploded by leaving the bottle in the temperature zone provided by the freezer compartment. It was experimentally verified that ordinary beer is not frozen at not less than −7° C.

When articles of food are stored in the new temperature zone, taste and nutritive values can be held since a quicker cooling speed in the new temperature zone in comparison with a partially frozen compartment (an icing temperature compartment) and a chilled compartment extends a term required for decreasing vitamin as a nutritive value and a term required for a change in a taste in terms of deliciousness. The quality of articles of food can be maintained in the new temperature zone since the decreasing amount of anthocyan as an index indicative of discoloration in articles of food, such as strawberry, is small and the changing speed of chlorophyll as an index indicative of discoloration in articles of food, such as spinach, is slow, for instance.

It has been stated that the quality of stored articles of food, in particular a denaturalization in protein, is generally affected as the speed passing through the maximum ice forming temperature zone (−1° C. to −50° C.) becomes slower. It is reported that when the passing speed is slow, crystals of ice grow larger and collapse cell membranes of articles of food to increase the dripping amount after thawing (cause tasty substance to leave) or to provide a bad feeling of crunchiness or crispness.

Figure 9:
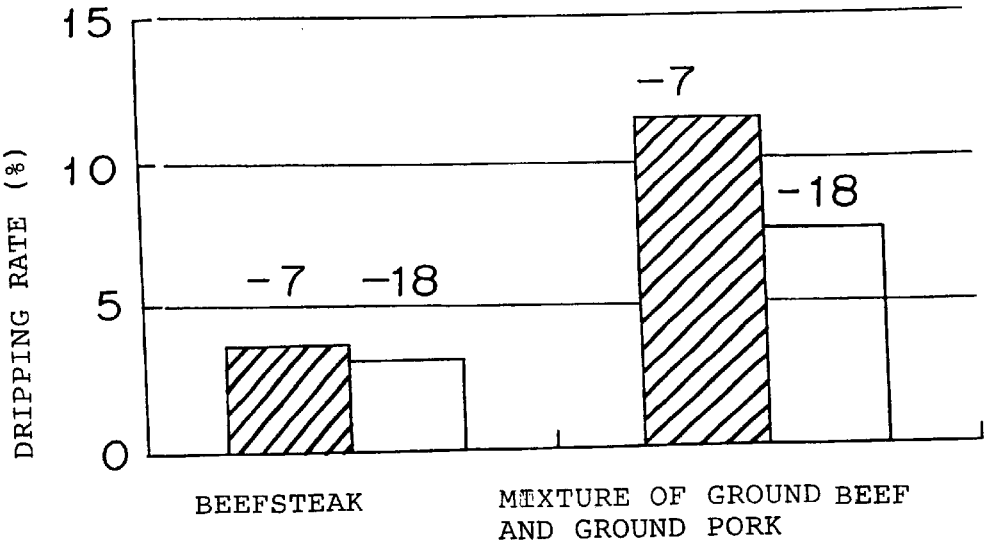
FIG. 9 is a graph showing dripping amounts of substance flowed out of articles of food in the first embodiment.
Figure 10:
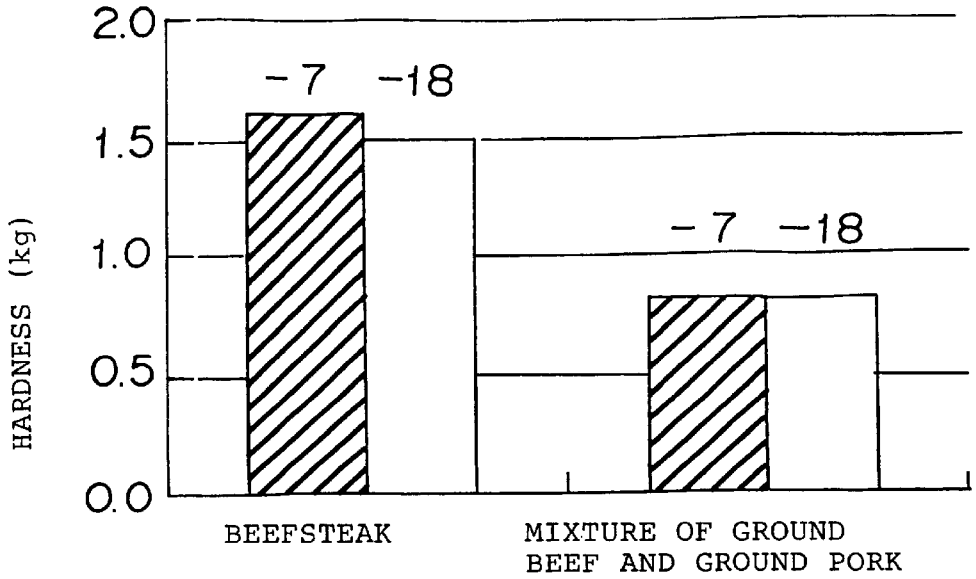
FIG. 10 is a graph showing compression stresses applied to articles of food in the first embodiment.
Figure 11:
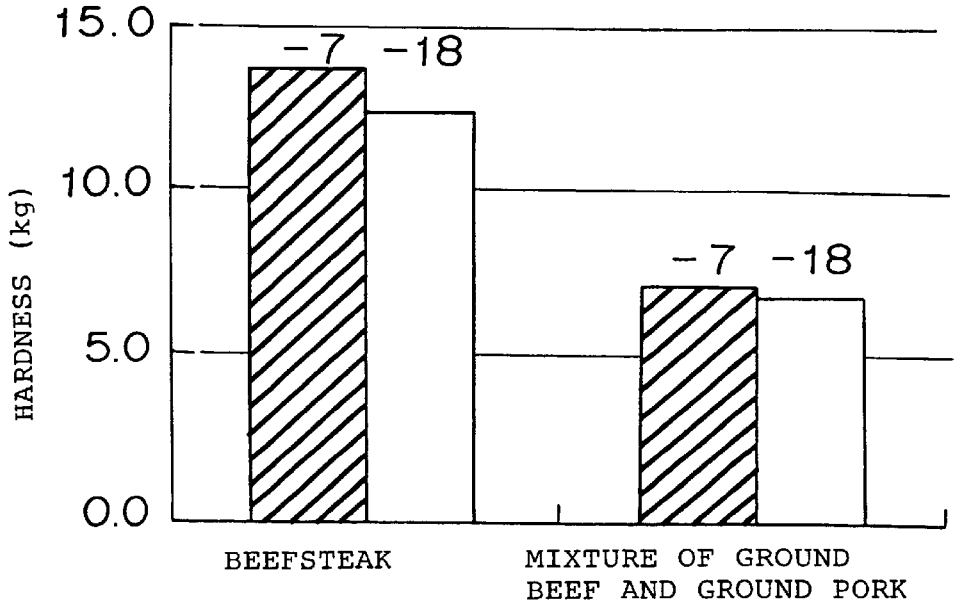
FIG. 11 is a graph showing compression stresses applied to articles of food in the first embodiment.
Figure 12:
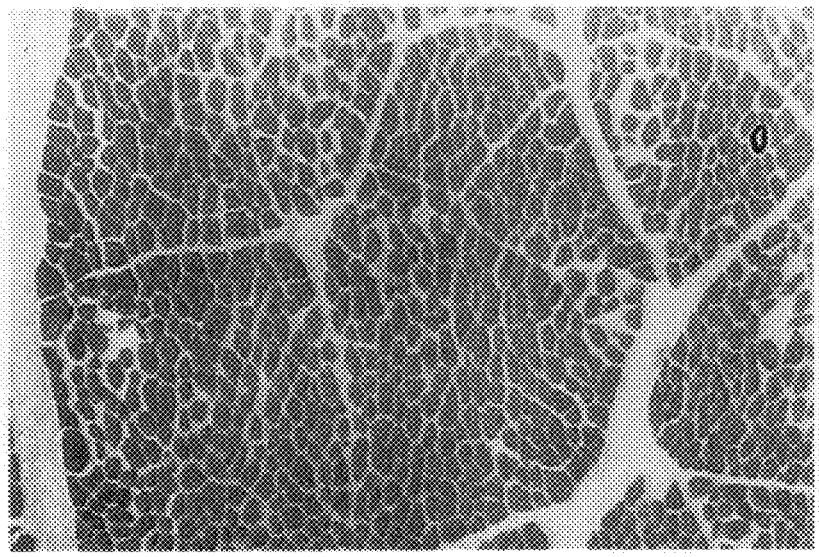
FIG. 12 is a picture showing a transverse section of the muscular tissue of an article of food observed microscopically in the first embodiment.
Figure 13:
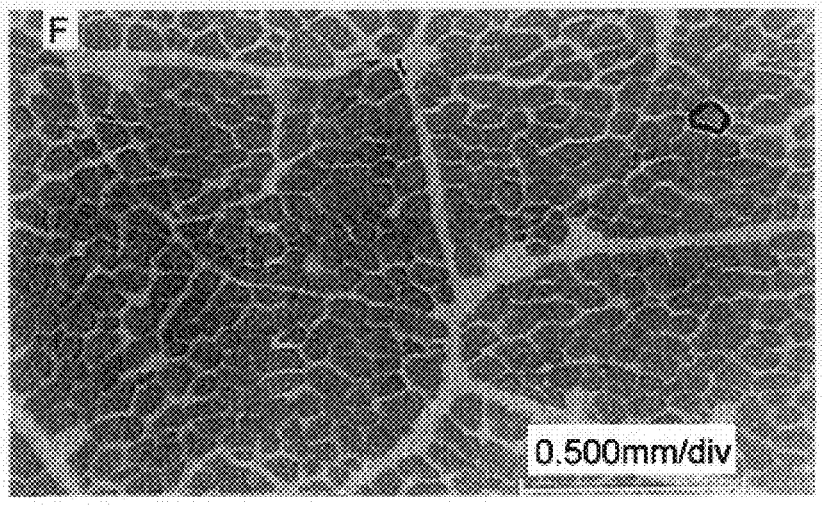
FIG. 13 is a picture showing a transverse section of the muscular tissue of another article of food observed microscopically in the first embodiment.

In FIG. 9 are shown values that were obtained by measuring the dripping amounts from beefsteak and a mixture of ground beef and ground pork that were thawed after having had been stored at −7° C. and −18° C. for 2 weeks. In FIG. 10 and 11 are shown data that were obtained by measuring the compression stress (hardness) of the cooked ones having had been stored and thawed in the same way as the articles shown in FIG. 9. In FIGS. 12 and 13 are shown the results that were obtained by microscopic observation of a transverse section of a muscular tissue of beefsteak after having had been stored and thawed in the same way as the articles shown in FIGS. 9 through 11. In FIGS. 12 and 13, black portions indicate muscular fibers and white portions indicate connective tissues (the main component is collagen).

The results show that there was no great difference between the articles frozen and stored at −7° C. and the article frozen and stored at −18° C. in terms of the dripping amount, and that there was no great difference between both tissue states. The results show that there was no significant difference between the articles frozen and stored at the respective temperatures in terms of compression stress indicative of a feeling of crunchiness or a crispness. The results indicate that the articles frozen and stored at the respective temperatures had no significant difference in terms of quantitative evaluation, and that no problem was created in terms of the quality of the articles of food. The microscopic observation shown in FIGS. 12 and 13 also indicate that the tissues had a systematic and uniform arrangement and were not subjected to a change such as collapse in the cell membranes. A taste test, which was carried out as a sensory test, shows that no difference was detected. In particular, it is clear that there is no problem in terms of actual use since articles of food are seasoned in most of cases.

The reason is supposed that the cell membranes in articles of food are not promptly collapsed by crystals of ice since the cell membranes are elastic and that the lapse of time is a great factor to the collapse. That is to say, it is supposed that the cell membranes are not collapsed by crystals of ice within a period of 2–3 weeks.

As explained, the storage in the new temperature zone proposed by the present invention can ensure the quality of articles of food within a period of 2–3 weeks and provide a convenient temperature. In comparison with the storage of articles of food by a chilled temperature (about 0° C.), a partially freezing temperature (about −3° C.) or a freezing temperature (about −18° C.) as the known-storing temperatures in the conventional refrigerators, the new temperature zone according to the present invention provide a new concept of storage as a new storing temperature, which combines a easy-to-use form as in the chilled or partially freezing temperature and a storing property as in the freezing temperature.

TABLE 4

Hardness and stickiness in boiled rice

| | Thawing time | Hardness | Stress (g) stickiness |
|---|---|---|---|
| Immediately after having boiled | — | 1605 | 256 |
| In 1 hour after having boiled | — | 1145 | 249 |
| 5° C. 1 W | 1 hour 30 minutes | 1660 | 49 |
| 0° C. 1 W | 1 hour 30 minutes | 1869 | 100 |
| −7° C. 1 W | 2 hours 30 minutes | 1163 | 64 |
| −18° C. 1 W | 3 hours | 1250 | 75 |

Thawing by microwave oven (500 W)

Figure 14:
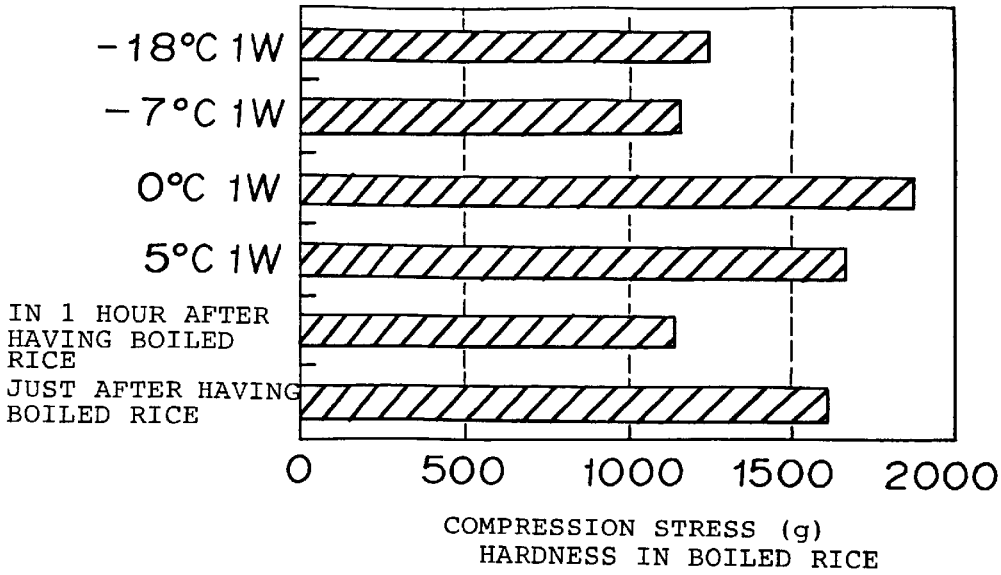
FIG. 14 is a graph showing the hardness of an article of food in the first embodiment.
Figure 15:
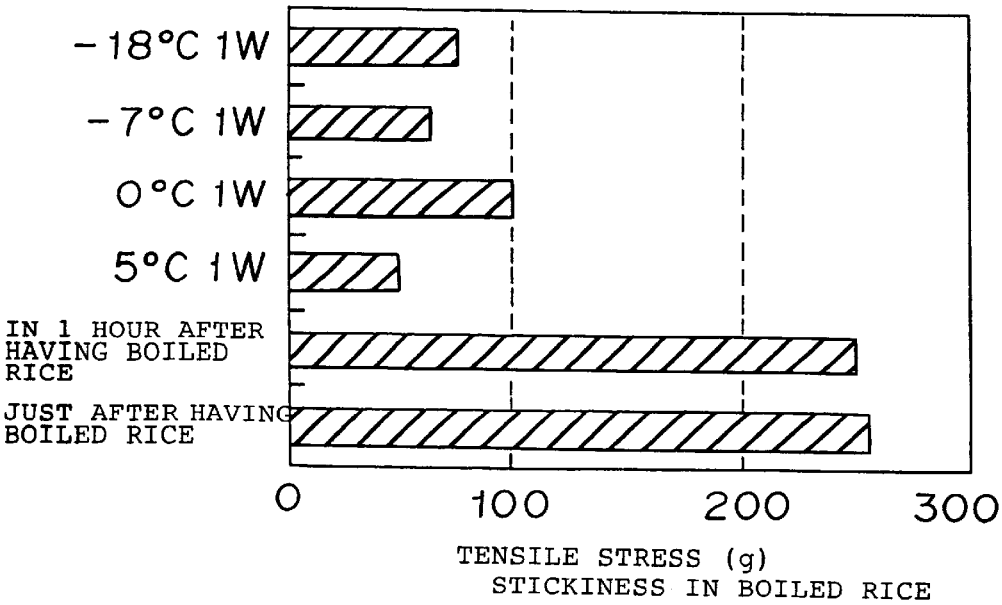
FIG. 15 is a graph showing the stickiness of the article in the first embodiment.

In Table 4 are shown influences on the thawing time, the hardness and the stickiness of an article of food in respective storage states (just after having boiled rice, in 1 hour after having boiled rice, and stored at 5° C., 0° C., −7° C. and −18° C.). In FIGS. 14 and 15 are shown the data on the hardness and the stickiness shown in Table 4 as bar graphs for comparison. The hardness of the boiled rice is represented by compression stresses (g) and the stickiness of the boiled rice is represented by tensile stresses (g).

The data show that the rice stored at storing temperatures of 0° C. and 5° C. became harder than the rice in 1 hour after having boiled the rice. The data show that the rice stored at temperatures of −7° C. and −18° C. were similar to the rice in 1 hour after having boiled rice, and find that the rice stored at these freezing temperatures created no problem in quality.

The data show that the storage in the new temperature zone according to the present invention can provide a superior storing property as well as an energy-saving property since the storage at a temperature of −7° C. can shorten the thawing time than the storage at a temperature of −18° C. This can apply to heating in cooking.

The data show that the article of food which was frozen at a temperature of −7° C. and was stored at a temperature −7° C. had quality equal to the article of food stored at a temperature −18° C. in the conventional freezing temperature zone, which is set to provide a superior effect to the conventional other storing temperature zones. If an article of food is used in 2 or 3 weeks, the article may be frozen and stored at a temperature of −18° C. first, be stored in a compartment at −7° C. at the time of using it, and be divided in pieces for use after having thawed to a temperature of −7° C. without having completely thawed. In the storage in the conventional freezing temperature, articles of food are required to be promptly used after having completely thawed. However, when articles of food has thawed at a temperature of −7° C., the articles are in a cuttable state and can be stored for a couple of weeks without trouble. Since the articles are cuttable, the articles are not required to be divided before being frozen, and the storage in the new temperature zone can provide convenience.

If articles of food are stored at a temperature of −7° C. so that they can be easily divided into pieces for use, and if the articles are not expected to be used for some time, the articles may be stored in the freezing temperature zone and be maintained at a lower temperature until next use. If the articles are used, the articles may be stored at a temperature of −7° C. before use.

In accordance with the present invention, the new temperature zone, which is an intermediate temperature zone between the complete freeze and the thaw, can be provided to make fuller and more reasonable use of articles of food.

Even if a chance of frozen meat or fish (an article of food that is quick frozen before sale) is inexpensive, such an article has been too large in terms of unit of sale for a family with a small number of members to buy the article since the article has been required to be used up after being thawed. However, the new temperature zone according to the present invention allows everybody to buy articles of food at lower prices and is expected to have influence on purchase of articles of food and patterns of distribution in the future since even a family with a small number of members can use the articles, dividing the articles in a semi-thawed state.

Although explanation of the new temperature zone according to the present invention has been made with respect to the reasonable use at home, the new temperature zone according to the present invention allows articles of food to be processed or stored at a lower temperature than conventional food processing so as to be cut or separated, being superior to the conventional food processing in terms of hygiene and processing.

As a mode of the present invention, there is provided a freezer compartment that automatically becomes a compartment in the new temperature zone on use of an article of food by setting a timer through a microcomputer or setting a day to use it or days left before use of it through a display on an outer surface of the refrigerator. Thus, the refrigerator can be utilized so that the article is taken out of the freezer compartment in the new temperature zone on using it and the article can be promptly cooked. For example, an article of food that is expected to use in a one month is stored in such a compartment and the timer is set. Provided that the article stored in the freezing temperature zone takes around 1 day to become at a temperature in the new temperature zone, the article can be available in a proper state on the expected day by inputting a day in 1 month minus 1 day (or days) into the timer. Since there is a possibility that the expected day is slightly changed, the timer may be set at a day in 1 month minus about 1 week (in about 3 weeks). The timer may be configured so as to automatically calculate a properly planned day shifted to the new temperature zone when an expected day is inputted.

In this manner, an articles of food can be stored in such way to be easily cooked by simple manipulation (setting), and the articles of food can be spent in an easy-to-cook state with good timing. Since neither sorting operation before thawing nor thawing operation is required, a wasteful time or work can be eliminated. If an article of food stored in a refrigerating compartment is used in a couple of days, it is sufficient to set the expected day since the article is slightly frozen in comparison with the refrigerated state so as to be instantly processed or cooked.

The storage in the new temperature zone according to the present invention has merits in easy-to-cut or easy-to-handle because of firmer tissues than raw tissues and in difficult propagation in bacteria because of a low temperature. The working area as well as articles of food per se may be set at a temperature of, e.g., −7° C. in the new temperature zone according to the present invention.

An increase in the number of most of bacteria which degrade articles of food can be restrained in the new temperature zone. The new temperature zone minimizes collapse of cells on freezing and restrains taste, and prevents flavor and nutritive value from being damaged since articles of food can not be completely frozen hard.

Since articles of food are subjected to soft-freezing (are softly frozen) in the new temperature zone, the energy that has been required to thaw articles of food for dividing the articles of food can be eliminated, saving energy. Since it is not necessary to thaw articles of food, a thawing step among series of steps from taking articles of food out of the refrigerator, thawing the articles of food, dividing the articles of food and starting cooking can be eliminated, shortening a time required for meal preparation.

Embodiment 2

Figure 16:
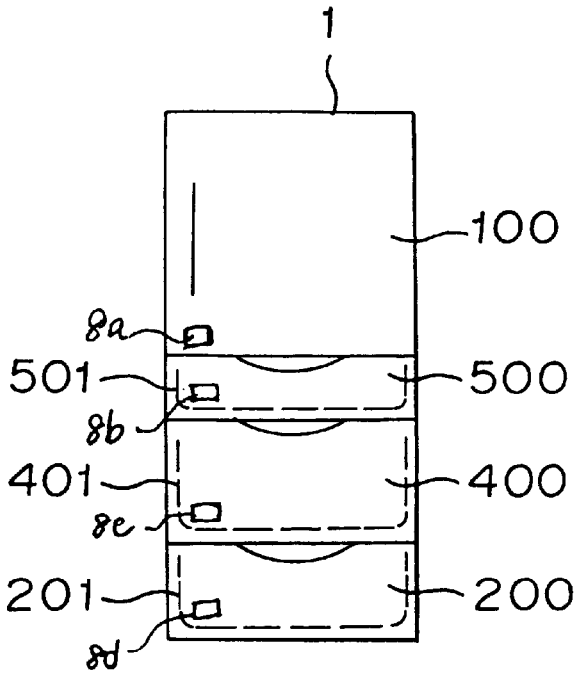
FIG. 16 is a view showing the compartment arrangement according to a second embodiment of the present invention.

In FIG. 16 is shown a second embodiment according to the present invention to explain the arrangement of compartments in the refrigerator. Reference numeral 500 designates a switchable compartment with a drawer, which is provided under a refrigerating compartment 100 and which can set the temperature zone therein at any one of the freezing temperature (−18° C.), the new temperature zone, an ordinary refrigerating compartment temperature, an ordinary vegetable compartment temperature and an ordinary chilled compartment temperature. Under the refrigerating compartment 100 are provided the switchable compartment 500, an ordinary freezer compartment 200 at the lowest portion, and a vegetable compartment 400 with a drawer provided between the switchable compartment and the freezer compartment. The switchable compartment 500 includes a storage casing 501 to store various kinds of articles of food. Likewise, the vegetable compartment 400 includes a storage casing 401.

For example, when the switchable compartment 500 is set at a temperature of around 0° C. in an icing temperature zone (a chilled temperature zone or a partially freezing compartment zone) to provide a compartment capable of storing articles of food for about one week without freezing the articles, the refrigerator can be easily accessible and convenient to a person fond of uncooked articles of food.

If the switchable compartment 500 is switched to a temperature (−18° C.) in the freezing temperature zone to store ice cream or ice in summer, such articles can be kept at an easily accessible position.

When the temperature in the switchable compartment 500 is switched to a temperature in the new temperature zone of freezer compartment 300 according to the first embodiment, the second embodiment can offer advantages similar to the first embodiment, providing the switchable compartment with a wide range of usage.

Reference numerals 8*a*–8*d* designate display units that indicate the temperature zone in the respective compartment. The display unit 8*a* shows the temperature in the refrigerating compartment 100, the display unit 8*b* shows the temperature in the switchable compartment 500, the display unit 8*c* shows the temperature in the vegetable compartment, and the display unit 8*d* shows the temperature in the freezer compartment. After the set values for the respective compartments are determined, the set values are stored in a microcomputer, and the data on the set values stored in the microcomputer are transmitted to the display units 8*a*–8*d* to show the respective temperatures. The display units may show actual temperatures at that time instead of the data on the set values or may show the actual temperatures as well as the set values. The indication of temperatures may be made with numerical values or different colors. Although the display units are provided on the respective compartments in the example shown in FIG. 16, a single display unit may be provided on only a compartment important to a user, such as the switchable compartment where the temperature zone is difficult to be seen, the new temperature zone of compartment, and the freezer compartment where the freezing temperature is required to be seen. A single display unit may show temperatures in the temperature zones of a plurality of compartments. Although the display units are provided on an outer surface of the refrigerator in the example shown in FIG. 16, the display units may be provided in the refrigerator.

Since at least one of the set temperature or actual temperature and the temperature zone for each of the compartments can be seen at a glance as explained, the temperature zone of the switchable compartment 500 can be seen without opening the refrigerator. This arrangement can avoid a case wherein if the switchable compartment is required to be opened, the other compartments will not be opened inadvertently. Even if the number of the temperature zones in the compartments increases, the present invention can provide a user-friendly refrigerator though the new temperature zone is added.

Embodiment 3

Figure 17:
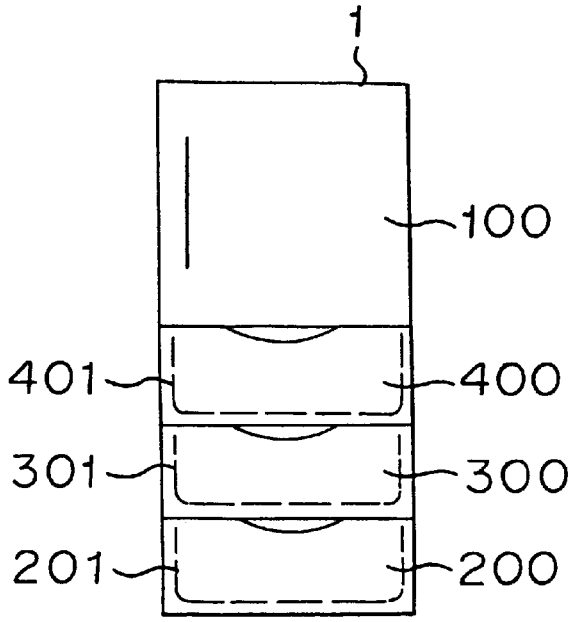
FIG. 17 is a view showing a compartment arrangement according to a third embodiment of the present invention.

In FIG. 17 is shown a third embodiment according to the present invention to explain an arrangement of compartments in a refrigerator 1. The refrigerator includes a refrigerating compartment 100 at an upper portion therein, a vegetable compartment 400 for storing vegetables under the refrigerating compartment, and a freezer compartment 200 at the lowest portion therein. The new temperature zone of freezer compartment 300 is provided between the vegetable compartment and the freezer compartment.

When one or more freezer compartments are provided in a refrigerator with the new temperature zone of freezer compartment independently provided therein, e.g. long storage of frozen food can be stored in the freezer compartment 200, and meals, leftovers in cooked food and meat required for division can be stored in the new temperature zone of freezer compartment 300, realizing separate storage so as to match with difference in usage. Having the leftovers at once (successively) becomes unnecessary, and having similar meals or articles of food at intervals in terms of days become possible.

The new temperature zone of freezer compartment 300 may be a switchable compartment which can be set at any one of the freezing temperature, a temperature in the new temperature zone, the refrigerating temperature, the vegetable compartment temperature and the icing temperature (chilled temperature).

Figure 18:
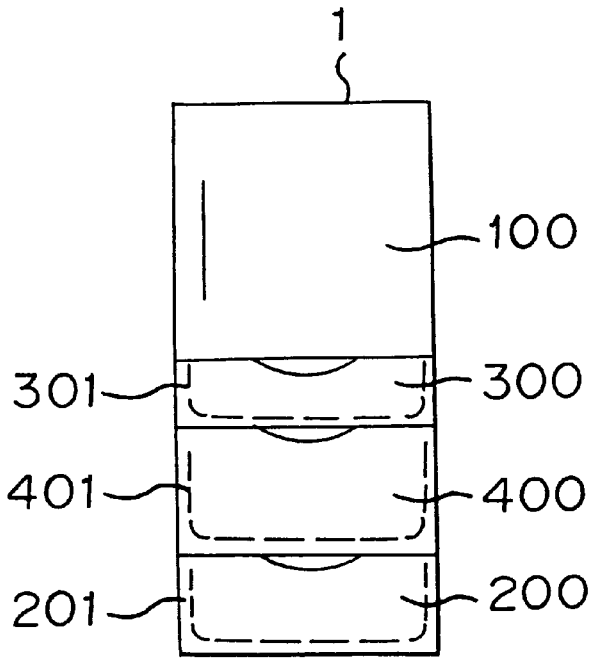
FIG. 18 is a view showing another compartment arrangement according to the third embodiment of the present invention.

As another arrangement of the compartments, the refrigerating compartment 100 is provided at an upper portion in the refrigerator, the new temperature zone of freezer compartment 300 is provided under the refrigerating compartment, the ordinary freezer compartment 200 is provided at the lowest portion in the refrigerator, and the vegetable compartment 400 is provided between the new temperature zone of freezer compartment and the ordinary freezer compartment as shown in FIG. 18.

The new temperature zone of freezer compartment 300 shown in FIG. 18 may be a compartment which can be set at any one of the freezing temperature, a temperature in the new temperature zone, the refrigerating temperature, the vegetable compartment temperature and the icing temperature (chilled temperature). By changing the set temperature for the new temperature zone of freezer compartment 300, the new temperature zone of freezer compartment can be set at temperatures in the respective temperature zones.

Figure 19:
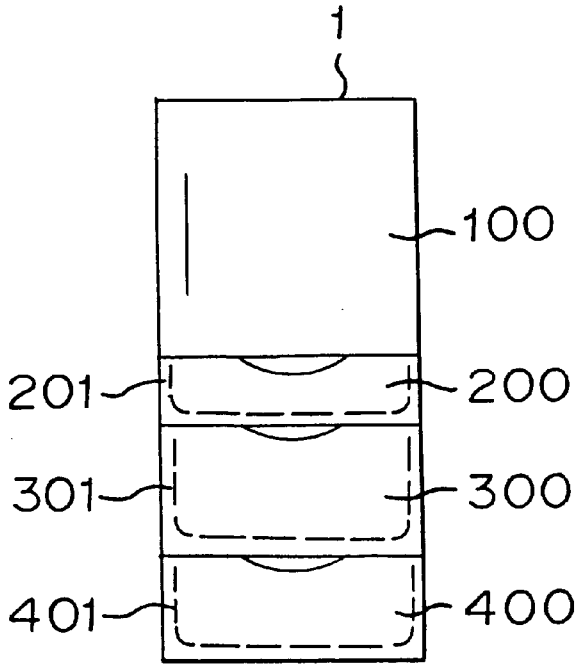
FIG. 19 is a view showing another compartment arrangement according to the third embodiment of the present invention.

The refrigerating compartment 100 may be provided at the upper portion in the refrigerator, the ordinary freezer compartment 200 is provided under the refrigerating compartment, the vegetable compartment 400 may be provided at the lowest portion in the refrigerator, and the new temperature zone freezer compartment 300 may be provided between the ordinary freezer compartment and the vegetable compartment as shown in FIG. 19.

The new temperature zone of freezer compartment 300 shown in FIG. 19 may be a compartment which can be switchable among a freezer compartment, the new temperature zone of freezer compartment, a refrigerating compartment, a vegetable compartment and an icing temperature compartment (chilled temperature compartment).

Figure 20:
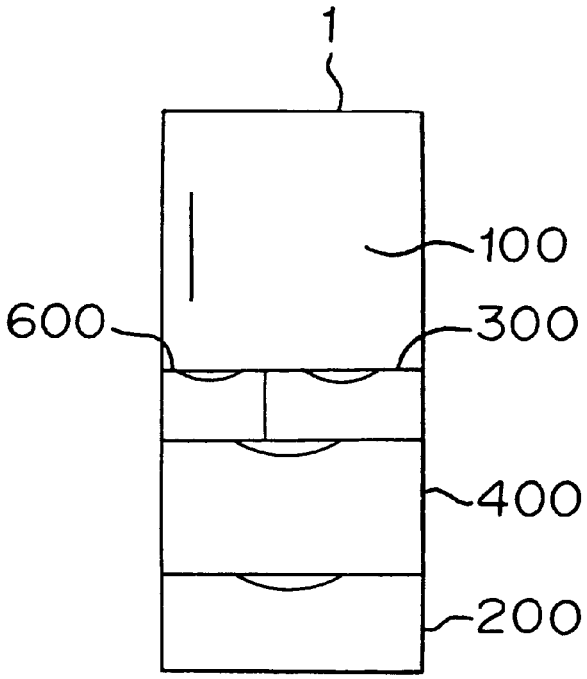
FIG. 20 is a view showing another compartment arrangement according to the third embodiment of the present invention.
Figure 21:
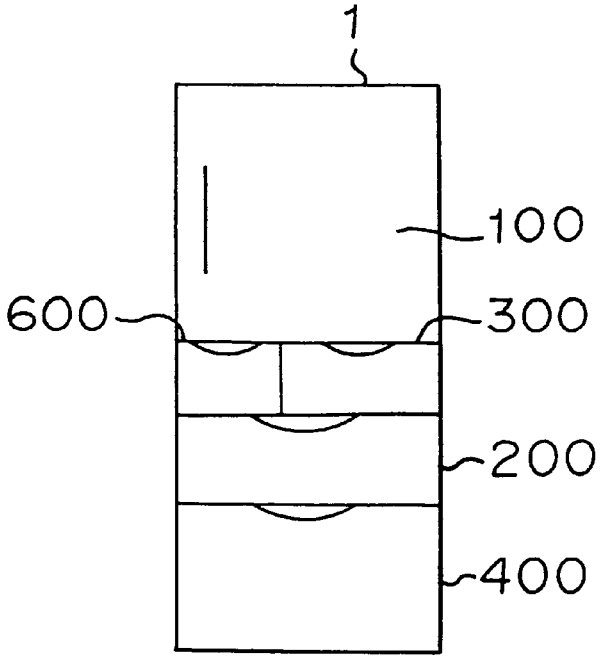
FIG. 21 is a view showing another compartment arrangement according to the third embodiment of the present invention.

As shown in FIG. 20, an ice storing compartment 600 may be independently provided so as to be in parallel with the new temperature zone of freezer compartment 300. That is to say, the refrigerating compartment 100 may be provided at the upper portion in the refrigerator, the new temperature zone of freezer compartment 300 and the ice storing compartment 600 are provided side by side under the refrigerating compartment, the ordinary freezer compartment 200 is provided at the lowest portion in the refrigerator, and the vegetable compartment 400 may be provided between the ordinary freezer compartment, and the new temperature zone of freezer compartment and the ice storing compartment provided side by side. As shown in FIG. 21, the refrigerating compartment may be provided at the upper portion in the refrigerator, the new temperature zone of freezer compartment 300 (which can be replaced by a compartment changeable among the freezer temperature zone, the new temperature zone, the refrigerating temperature zone, the vegetable compartment temperature zone and the chilled temperature zone) and the ice storing chamber 600 may be provided side by side under the refrigerating compartment, the vegetable compartment may be provided at the lowest portion in the refrigerator, and the ordinary freezer compartment 200 may be provided between the vegetable compartment, and the new temperature zone of freezer compartment and the ice storing compartment provided side by side.

The new temperature zone of freezer compartment 300 may be a compartment which is changeable to any one of a freezer compartment, the new temperature zone of freezer compartment, a refrigerating compartment, a vegetable compartment and an ice temperature compartment (chilled temperature compartment).

When the new temperature zone of freezer compartment 300 is provided above the ordinary freezer compartment 200, accessibility is improved since the new temperature zone of freezer compartment has a shorter storing term and a greater frequency of access than the ordinary freezer compartment. The ordinary freezer compartment is provided at a lower portion in the refrigerator since the ordinary freezer compartment has a small frequency of access than the refrigerating compartment and the vegetable compartment. When the ordinary freezer compartment is provided at a lower portion in the refrigerator, it is preferable that the freezer compartment is provided with a drawer instead of a door for easy access to articles of food stored at a deep position therein.

Embodiment 4

Figure 22:
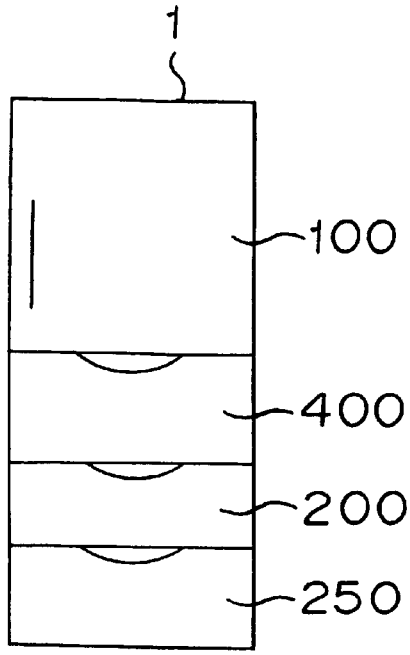
FIG. 22 is a view showing the compartment arrangement according to a fourth embodiment of the present invention.

Although separate storage by the provision of one or more of ordinary freezer compartments in addition to the independent new temperature zone of freezer compartment 300 has been referred to in the explanation of the third embodiment, there is a case wherein two or more of compartments suited for long term of storage are required rather than a demand of separate storage when being away from home for a long term due to travel for instance. For example, the provision of two compartments for long term of storage can be realized by providing the refrigerating compartment 100 at an upper portion in the refrigerator, the vegetable compartment 400 under the refrigerating compartment, a first freezer compartment 200 under the vegetable compartment, and a second freezer compartment 250 at the lowest portion in the refrigerator as shown in FIG. 22 so that one of the two freezer compartments (there may be provided more than two of freezer compartments) can be set to any one of a new temperature zone of freezer compartment and an ordinary freezer compartment.

When one of the two freezer compartments is the ordinary freezer compartment and the other is the new temperature zone of freezer compartment, the provision of the new temperature zone of freezer compartment above the ordinary freezer compartment improves accessibility since the new temperature zone of freezer compartment provides a shorter storing term and has a greater frequency of access than the ordinary freezer compartment.

Embodiment 5

Figure 23:
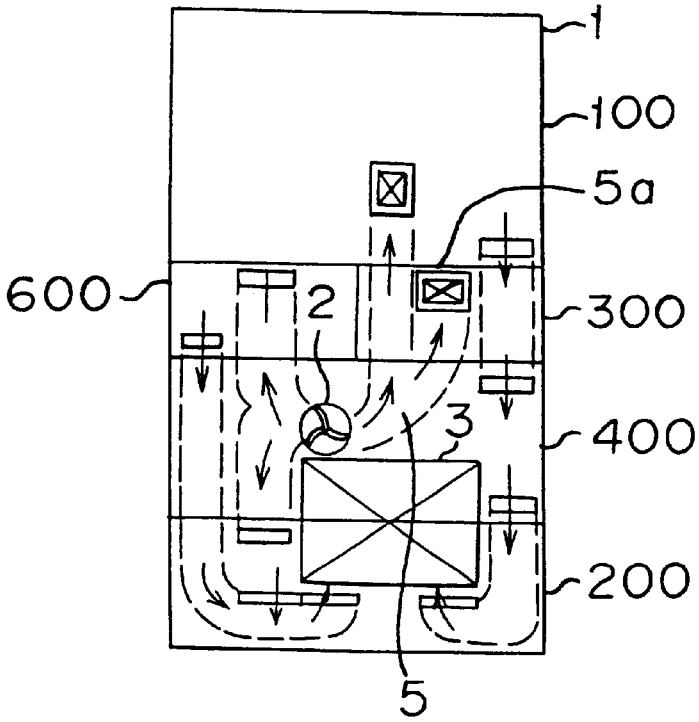
FIG. 23 is a view showing the air path structure according to a fifth embodiment of the present invention.

FIG. 23 is shown an example of the air path structure of the refrigerator according to a fifth embodiment of the present invention. The compartment structure of the refrigerator shown in FIG. 20 is adopted in the fifth embodiment as an example. The refrigerator includes the refrigerating compartment 100 at an upper portion therein, the ice storing compartment 600 and the new temperature zone of freezer compartment 300 provided side by side under the refrigerating compartment, the ordinary freezer compartment 200 at the lowest portion therein, and the vegetable compartment 400 above the ordinary freezer compartment.

In this figure, reference numeral 2 designates the fan motor for circulating the cooled air, reference numeral 3 designates the cooling device and reference numeral 5 designates the air path for the new temperature zone of freezer compartment. The damper 5*a* are opened and closed to control the flow rate of the cooled air in order to carry out temperature control in the new temperature zone of freezer compartment 300 so as to obtain a set temperature therein. The damper 5*a* is provided in the air path, and the damper can control the blowing amount of the cooled air into the new temperature zone of freezer compartment 300 to carry out the temperature control in the new temperature zone of freezer compartment.

For example, in a case wherein the set temperature in the new temperature zone of freezer compartment is −7° C., the damper 5*a* is closed to shut the cooled air when the temperature detector (the thermistor for temperature detection) 302 in the new temperature zone of freezer compartment detects that the temperature in the new temperature zone of freezer compartment is −7.5° C. When the temperature in the new temperature zone of freezer compartment rises to −6.5° C. after that, the damper 5*a* is opened to flow the cooled air into new temperature zone of freezer compartment. Such operation can be repeated to realize stable temperature control in the new temperature zone of freezer compartment.

Embodiment 6

Figure 24:
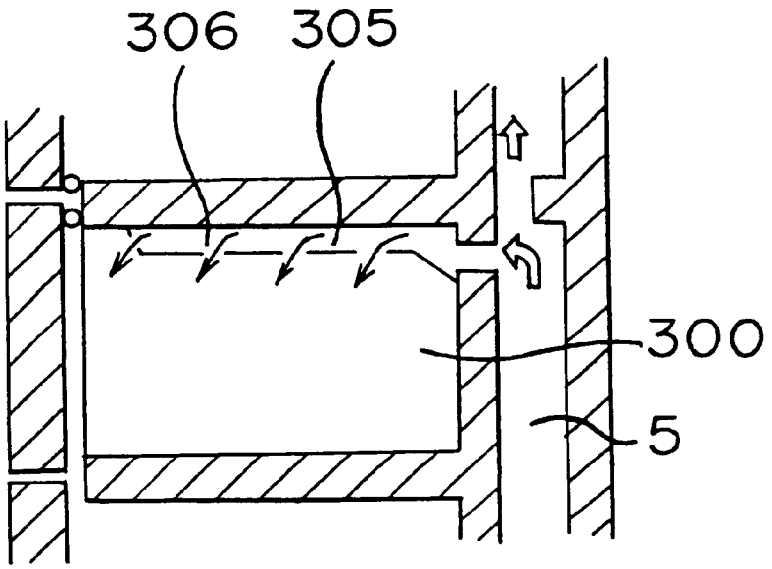
FIG. 24 is a view showing an air path structure according to a sixth embodiment of the present invention.

FIG. 24 is shown a cross-sectional side view of the new temperature zone of freezer compartment 300 according to a sixth embodiment of the present invention to explain an air path structure for the new temperature zone of freezer compartment 300. Reference numeral 5 designates an air path for the new temperature zone of freezer compartment, which supplies the cooled air into the new temperature zone of freezer compartment 300.

As shown in this figure, the new temperature zone of freezer compartment 300 has an extension air path for blowing out the cooled air thereinto provided on a top wall 305 thereof, and the extension air path is formed with cooled air outlets 306 to provide a better temperature distribution.

Even if the extension air path is provided independently from the top wall, stable temperature control can be obtained likewise.

Figure 25:
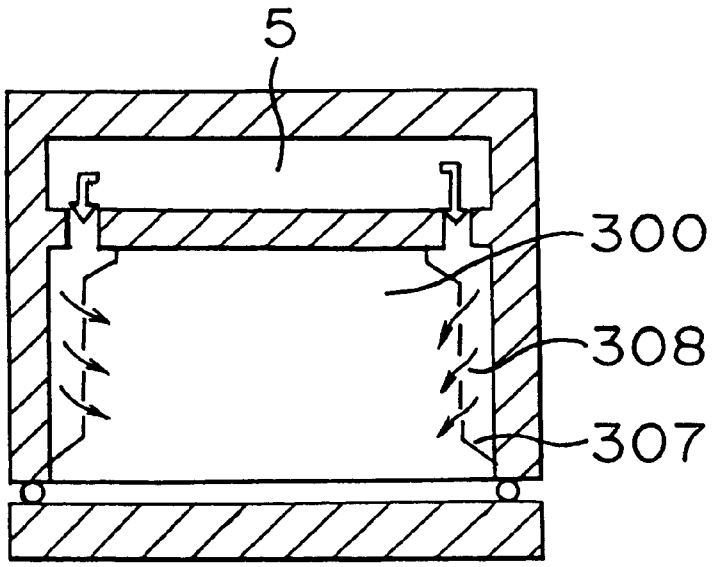
FIG. 25 is a view showing an air path structure according to the sixth embodiment of the present invention.

As shown in a cross-sectional plan view of FIG. 25, the new temperature zone of freezer compartment 300 may have the extension air path provided on at least one of both side walls 307 thereof instead of the top wall 305, and the extension air path may be formed with cooled air outlets 308, offering similar effects.

When the extension air path is provided on each of the top wall 305 and the side walls 307, more stable temperature control can be realized in the new temperature zone of freezer compartment.

When a tray which has a bottom made of good thermal conductivity of material such as aluminum is put in the new temperature zone freezer compartment, or when a storage case to be put in the new temperature zone of freezer compartment is made of good thermal conductivity of material, the temperature distribution is improved.

Although the new temperature zone of freezer compartment 300 is shown to be a compartment separated by partition walls and so on in the embodiments, the new temperature zone of freezer compartment may be provided in a compartment having a different temperature zone by separating with a casing for instance.

Figure 26:
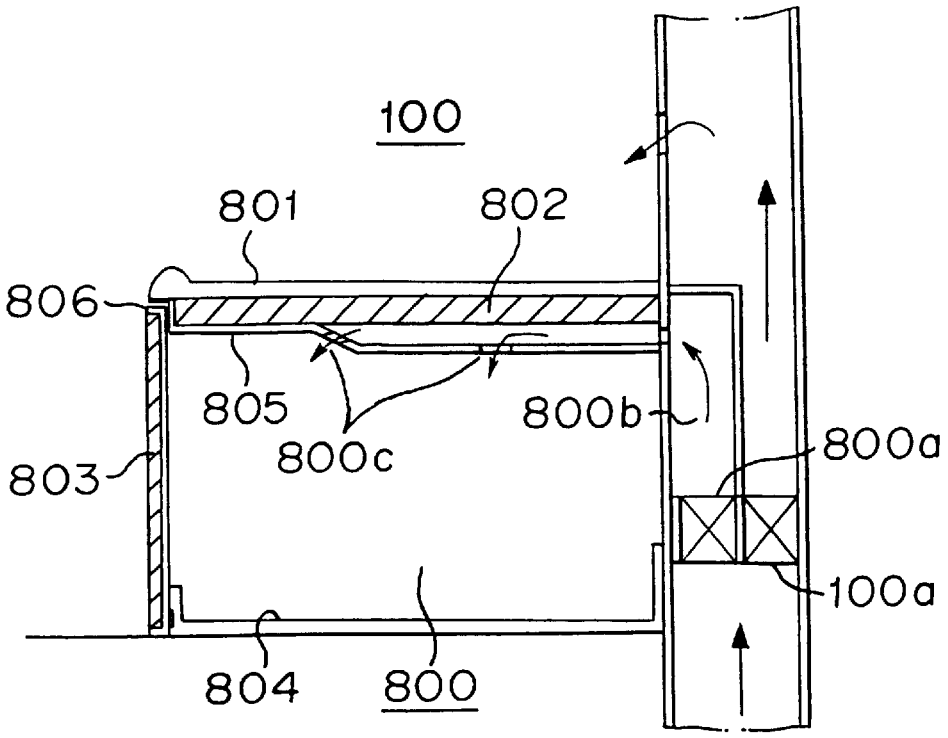
FIG. 26 is a cross-sectional view of a storage section provided in a refrigerating compartment according to the sixth embodiment.

In FIG. 26 is shown a cross-sectional view of a storage section 800 provided in the refrigerating compartment 100. Reference numeral 801 designates a partition wall to the refrigerating compartment 100. Reference numeral 802 designates thermal insulation material for insulating the storage section 800 from the refrigerating compartment 100. Reference numeral 805 designates a duct which is provided on the thermal insulation material 802 to provide an air path for cooling the storage section 800. Reference numeral 800*c* designate outlets provided in the duct 805. The storage section 800 has a front portion provided with a lid 803. The lid 803 has thermal insulation material or thermal insulation by air provided therein, and the lid has packing 806 provided on the circumference thereof. The storage section has a tray 804 put at the bottom therein, and the tray is made of plastic material or good thermal conductivity of material such as aluminum. The storage section 800 is cooled by controlling a damper 800*a* for airflow rate adjustment so that the cooled air generated by the cooling device is supplied into the storage section 800 to provide the storage section with a set temperature. Reference numeral 100*a* designates a damper for a refrigerating compartment 100.

Figure 27:
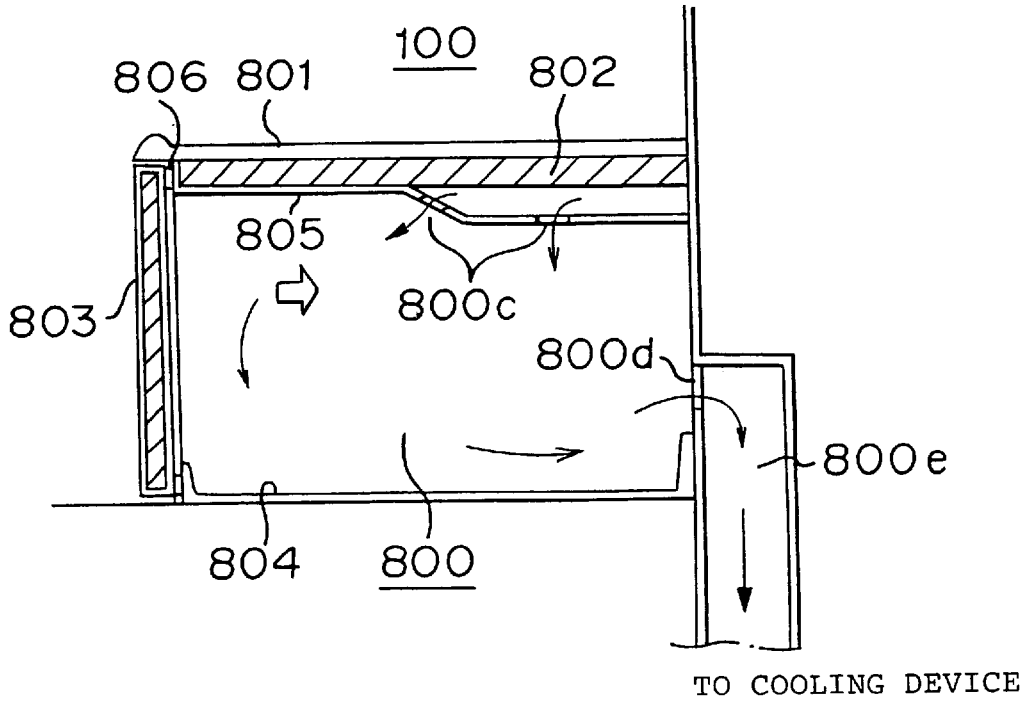
FIG. 27 is a cross-sectional view of the storage section and a return path therefor according to the sixth embodiment.
Figure 28:
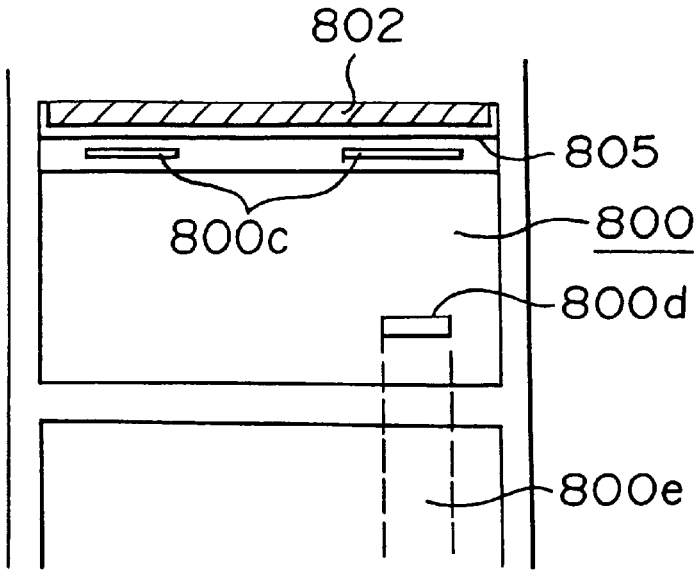
FIG. 28 is a cross-sectional view of the storage section as viewed from the direction indicated by an arrow A in FIG. 27.

In FIG. 27 is shown a cross-sectional view of the storage section 800 including a return path. In FIG. 28 is shown a cross-sectional view of the storage section as viewed from the direction indicated by an arrow A in FIG. 27. Reference numeral 800*d* designates an inlet for the storage section 800, through which the cooled air that has been blown out of the outlets 800*c* and circulated in the storage section paths to is returned to the cooling device via the return path 800*e*. The return path 800*e* for the storage section 800 is provided independently of the other return paths so that the returned cooled air in the return path 800*e* is independent of the returned cooled air having an increased temperature and humidity, such as the returned cooled air from the refrigerating compartment, and is prevented from mixing with the other returned cooled air to avoid the formation of ice in the return path 800*e*.

Figure 29:
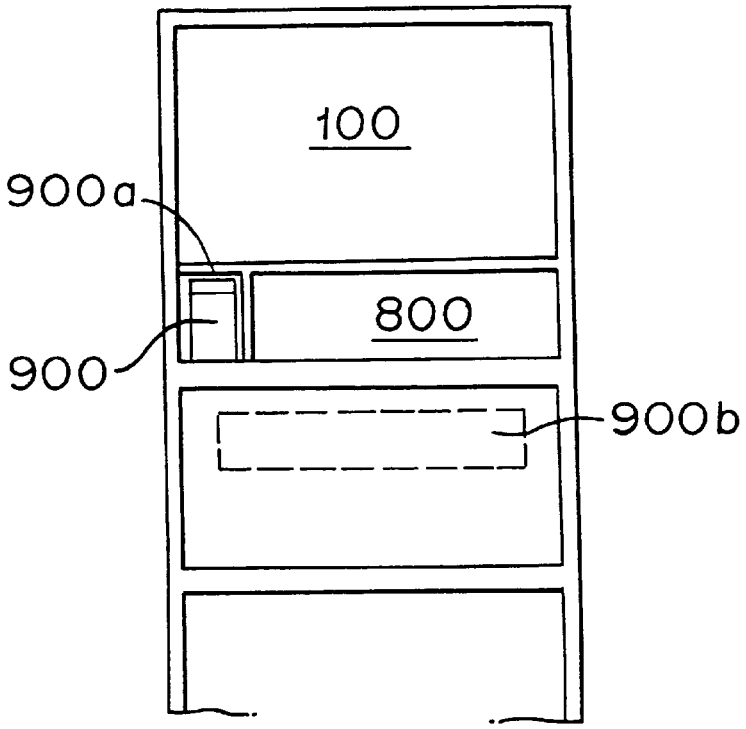
FIG. 29 is a front view of a refrigerating compartment according to the sixth embodiment.
Figure 30:
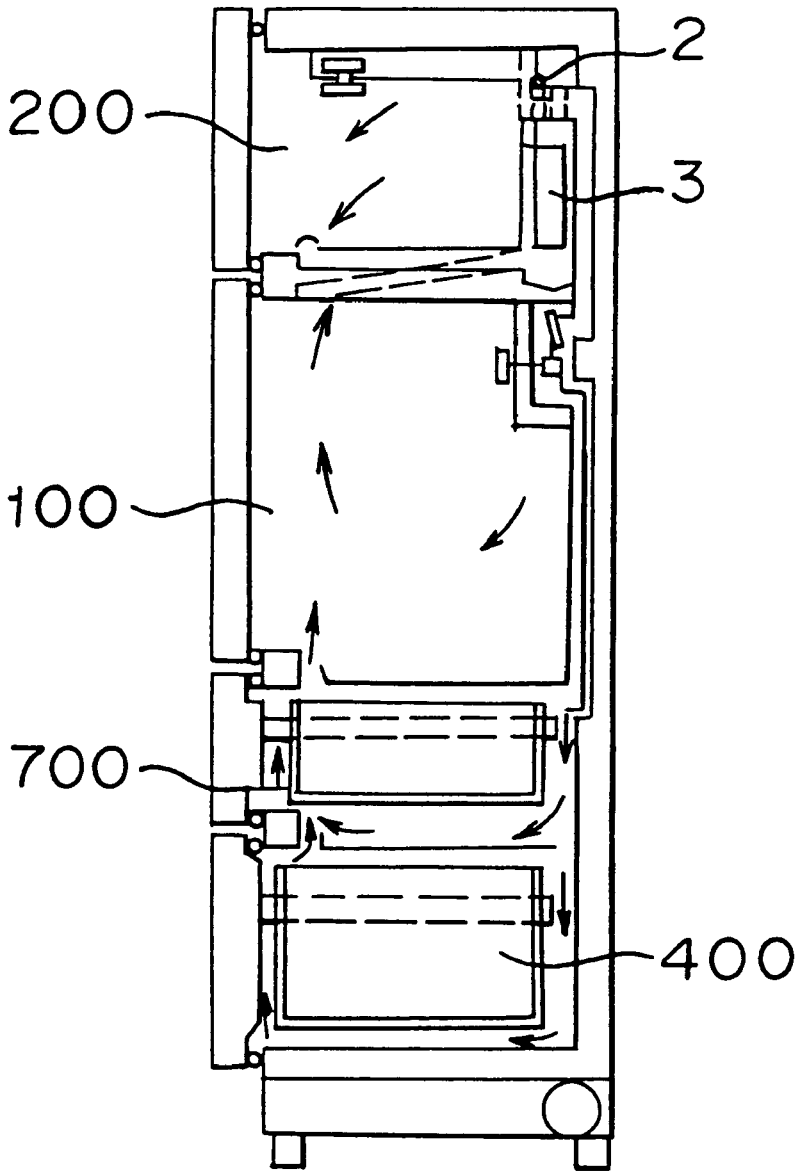
FIG. 30 PRIOR ART
FIG. 30 is a cross-sectional side view of a conventional refrigerator.

In FIG. 29 is shown a front view of the refrigerating compartment 100, which has a water supply tank 900 for an automatic ice making device provided on a bottom surface thereof. Reference numeral 900*a* designates a heater for avoiding the formation of ice in the water supply tank 900, which prevents ice from being formed under the influence of the temperature in the storage section 800. Reference numeral 900*b* designates a heater for preventing the formation of ice in a compartment under the storage section 800, which is provided on at a rear portion of the refrigerator main body so that the compartment is prevented from being affected by the temperature in the storage section 800. If the storage section 800 is set as the new temperature zone of freezer compartment according to the present invention, the switchable compartment referred to in the other embodiments may be used to carry out freezing as a compartment specialized for ice cream so as to be matched with the life pattern of a user, or the switchable compartment may be set at a temperature in the new temperature zone and is combined with the new temperature zone of freezer compartment to provide a large volume of storage in the new temperature zone.

Although explanation has been made with respect to a case wherein the storage section 800 is provided in the refrigerating compartment 100, the storage section 800 may be provided in a compartment (having a door common to the storage section) having a different storing temperature from the refrigerating compartment, or a plurality of storage sections may be provided in a compartment with a door common to the storage section so as to be matched with the usage of the refrigerator to a user. For example, if a plurality of storage sections are provided so as to work as a new temperature zone of freezer section and a refrigerating section in the refrigerating compartment, and if an article of food that has been stored in the refrigerating section to be promptly used is required to be stored for 2 or 3 weeks because of a change in the plan, the article can be moved to the new temperature zone of freezer section in the common door, providing easy work. For example, the new temperature zone freezer section is provided in the freezer compartment, and if an article of food that has been stored in the new temperature zone of freezer section because of planned use in 2 or 3 weeks is required to be stored for a long term because of a change in the plan, the article can be easily moved to the freezer compartment, making reasonable use of the refrigerator. The reverse movement of each of the articles between the section and the compartment can be easily made. A combination of the section and the compartment may be selected so as to be matched with the usage of a user, and the arrangement of the section and the compartment in the vertical or horizontal direction may be selected so as to be matched with the usage of the user. The storage section may be separated by a simple partition wall.

The provision of not less than two of switchable sections or independent compartments in the refrigerator can provide the refrigerator with temperature zones, which are well matched with the dietary habits of the user.

The compartment as the freezer compartment may be configured to be automatically and variably set at a temperature in the new temperature zone (about −7° C.) by being controlled under a microcomputer based on an input through a switch on the external surface of the refrigerator or a temperature control in the refrigerator. By such arrangement, if an article of food that is expected to be stored for 2 or 3 weeks is erroneously put in the new temperature zone of freezer compartment set for long term of storage, or a plan to use an article of food is suddenly changed, proper temperature setting can be made by such simple operation (modification in setting) without moving the article, providing the refrigerator with an energy-saving property.

A cold storage (large size refrigerator), chilled car for frozen food and so on may have the temperature therein set at an arbitrarily storing temperature including a temperature in the temperature zone of the new temperature zone of freezer compartment (soft-freezing room). The storing temperature can be sequentially changed in the temperature zone not higher than the lower limit of the maximum ice forming temperature zone (from −1° C. to −5° C.) and higher than the freezing temperature zone (from −18° C. to −20° C.) so as to be adequately set, depending on storing days (transportation days), the purpose for storage and the contents of articles of food. The storing temperature may be changeable to any temperature value at any time, using the temperature control method referred to be respect to the first embodiment. Thus, the articles of food can be frozen for storage in a better state.

Obviously, numerous modifications and variations of the present invention are possible in light of the above teachings. It is therefore to be understood that within the scope of the appended claims, the invention may be practiced otherwise than as specifically described herein.

What is claimed is:

1. A refrigerator comprising:

a housing defining a volume;

a freezer compartment in said volume and having a temperature colder than −15° C.;

a refrigerating compartment in said volume and having a temperature higher than −5° C.;

a cooling device configured to cool air to be supplied to each compartment;

a new temperature zone freezer compartment in said volume, said new temperature zone freezer compartment receiving high temperature air from said refrigerating compartment and low temperature air directly from the cooling device; and a low temperature air controller including a damper positioned and adapted to control a flow of low temperature air to said new temperature zone freezer compartment so as to maintain a temperature in said new temperature zone freezer compartment between −5° C. and −15° C.

2. A refrigerator according to claim 1, wherein the freezer compartment has a temperature from about −18° C. to about −20° C.

3. A refrigerator according to claim 1, further comprising:

at least one temperature display configured to display a temperature of at least one of the freezer compartment, the refrigerating compartment and the new temperature zone freezer compartment.

4. A refrigerator according to claim 1, further comprising:

an icing temperature compartment, wherein the new temperature zone freezer compartment is configured to cool food items at a cooling speed faster than that in the icing temperature compartment and slower than that in the freezer compartment.

5. A refrigerator according to claim 1, wherein the new temperature zone freezer compartment is provided with a return path for cooled air, the return path being independent of other return paths for cooled air.

6. A refrigerator according to claim 1, wherein the new temperature zone freezer compartment is configured to maintain freezing articles of food at about −7° C. in such a state that the frozen articles of food can be divided by a kitchen knife or hands.

7. A refrigerator according to claim 1, wherein the new temperature zone freezer compartment is provided as at least one of sections divided in a single compartment with a common door.

8. A refrigerator according to claim 1, wherein the new temperature zone freezer compartment is provided at a higher position than the freezer compartment.

9. A refrigerator according to claim 1, wherein the new temperature zone freezer compartment includes a tray made of good thermal conductivity of material, such as aluminum.

* * * * *

UNITED STATES PATENT AND TRADEMARK OFFICE

CERTIFICATE OF CORRECTION

PATENT NO. : 6,314,746 B2
DATED : November 13, 2001
INVENTOR(S) : Ohya et al.

It is certified that error appears in the above-identified patent and that said Letters Patent is hereby corrected as shown below:

Title page,
Item [73], Assignee, information should read:
-- (73) Assignee: Mitsubishi Denki Kabushiki Kaisha, Tokoyo (JP) --

Signed and Sealed this

Eighteenth Day of May, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,314,746 B2
DATED : November 13, 2001
INVENTOR(S) : Ohya et al.

It is certified that error appears in the above-identified patent and that said Letters Patent is hereby corrected as shown below:

Title page,
Item [73], Assignee, information should read:
-- (73) Assignee: Mitsubishi Denki Kabushiki Kaisha, Tokyo (JP) --

This certificate supersedes Certificate of Correction issued May 18, 2004.

Signed and Sealed this

Thirteenth Day of July, 2004

JON W. DUDAS
*Acting Director of the United States Patent and Trademark Office*